US007921789B2

(12) United States Patent
Bailey et al.

(10) Patent No.: US 7,921,789 B2
(45) Date of Patent: Apr. 12, 2011

(54) CARPET AND METHOD OF MAKING SAME

(75) Inventors: James H. Bailey, Cartersville, GA (US); Paul A. Young, Atlanta, GA (US)

(73) Assignee: Columbia Insurance Company, Omaha, NE (US)

( * ) Notice: Subject to any disclaimer, the term of this patent is extended or adjusted under 35 U.S.C. 154(b) by 726 days.

(21) Appl. No.: 11/453,285

(22) Filed: Jun. 13, 2006

(65) Prior Publication Data

US 2006/0280901 A1 Dec. 14, 2006

Related U.S. Application Data

(60) Provisional application No. 60/689,934, filed on Jun. 13, 2005.

(51) Int. Cl.
*D05C 17/02* (2006.01)
*A47G 27/02* (2006.01)

(52) U.S. Cl. ..... 112/410; 428/44; 428/85

(58) Field of Classification Search ..... 428/85, 428/89, 88, 44, 48; 112/410; D06/582, 588; D05/62, 59, 61
See application file for complete search history.

(56) References Cited

U.S. PATENT DOCUMENTS

| | | | | |
|---|---|---|---|---|
| 6,841,216 | B2 * | 1/2005 | Daniel et al. | 428/48 |
| 6,854,146 | B2 * | 2/2005 | Stoyles et al. | 8/150 |
| 6,884,493 | B2 * | 4/2005 | Magee et al. | 428/175 |
| 6,908,656 | B2 * | 6/2005 | Daniel et al. | 428/88 |
| 6,945,007 | B2 * | 9/2005 | Kobayashi et al. | 52/749.11 |
| 6,990,703 | B2 * | 1/2006 | Brown et al. | 8/150 |
| 7,083,841 | B2 * | 8/2006 | Oakey et al. | 428/88 |
| D549,029 | S * | 8/2007 | Daniel et al. | D6/582 |
| 7,297,385 | B2 * | 11/2007 | Daniel et al. | 428/48 |
| 7,356,453 | B2 * | 4/2008 | Gould | 703/22 |
| 2002/0103719 | A1 * | 8/2002 | Beedy | 705/26 |
| 2003/0031821 | A1 * | 2/2003 | Oakey et al. | 428/44 |
| 2003/0143359 | A1 * | 7/2003 | Daniel et al. | 428/44 |
| 2003/0190450 | A1 * | 10/2003 | Daniel et al. | 428/89 |
| 2003/0207067 | A1 * | 11/2003 | Daniel et al. | 428/44 |
| 2003/0211274 | A1 * | 11/2003 | Daniel et al. | 428/44 |
| 2006/0040089 | A1 * | 2/2006 | Daniel et al. | 428/88 |
| 2006/0080125 | A1 * | 4/2006 | Shipman et al. | 705/1 |
| 2006/0093994 | A1 * | 5/2006 | Grant | 434/98 |
| 2006/0233996 | A1 * | 10/2006 | Oakey et al. | 428/44 |
| 2006/0240210 | A1 * | 10/2006 | Daniel et al. | 428/44 |
| 2006/0240211 | A1 * | 10/2006 | Daniel et al. | 428/44 |
| 2006/0251846 | A1 * | 11/2006 | Daniel et al. | 428/44 |
| 2006/0280901 | A1 * | 12/2006 | Bailey et al. | 428/85 |

FOREIGN PATENT DOCUMENTS

| | | | |
|---|---|---|---|
| JP | 2008086482 | A * | 4/2008 |
| JP | 2008088676 | A * | 4/2008 |
| WO | WO 2005026863 | A2 * | 3/2005 |

* cited by examiner

*Primary Examiner* — Cheryl Juska
(74) *Attorney, Agent, or Firm* — Ballard Spahr LLP

(57) ABSTRACT

A carpet that can be installed onto a flooring surface without the requirement for registration between adjacent broadloom carpet pieces. The carpet comprises a design member that comprises a plurality of pattern members that are colorized and that define a void area, which has a substantially uniform color and pile height.

18 Claims, 36 Drawing Sheets

CARPET AND METHOD OF MAKING SAME

CROSS-REFERENCE TO RELATED APPLICATIONS

This application claims priority to and the benefit of U.S. Provisional Application No. 60/689,934, filed on Jun. 13, 2005.

FIELD OF THE INVENTION

This invention relates generally to carpet and a method of designing carpet having patterns and color schemes that allow for placement of the carpet with respect to adjacent pieces of carpet without registration between the respective carpet pieces.

BACKGROUND OF THE INVENTION

Many conventional carpets have a visually discernable pattern such that, in a flooring installation, adjoining carpet pieces must be positioned in the same orientation, and often in registration, so that discontinuities are not visible when the carpet pieces are joined. This is because conventional carpet normally has a "direction" as a result of the manufacturing process, the pattern on the carpet, and/or the coloration of the pattern on the carpet. Further, conventional production techniques, particularly including tufting techniques, cause the carpet pile to lean or have a nap direction. This "nap" of the carpet causes the carpet piece to have a different appearance depending on variations in lighting and viewing conditions if it is positioned in a different direction than the adjoining piece of carpet with which it is placed.

Thus, conventional installation of many carpet styles requires careful attention to the respective positions of the adjoining pieces of carpet so that a pattern "match" occurs between the adjoining carpet pieces. Conventional carpet designs require tedious installation on basic side-to-side or butt-to-butt installation of adjoining carpet pieces. This matching process is further complicated as variations in color may require that adjoining carpet pieces in a particular flooring installation all use rolls or pieces dyed in the same dye lot to avoid the potential for unacceptable differences between adjacent carpet pieces resulting from variations in dying.

Thus, the appearance of the entire carpet installation may be compromised if one conventional carpet broadloom piece in a flooring installation is not properly matched to adjacent carpet broadloom pieces. The carpet installer, therefore, must ensure proper pattern matching of the respective adjoining carpet pieces. This may necessitate the removal of portion of the adjoining carpet broadloom pieces to obtain the proper pattern match, which results in carpet waste and additional installation and product expense.

A substantial demand exists for flooring designs that have a design that can cover the entire flooring installation or part of the flooring installation and that allows for ready installation of adjoining pieces of broadloom carpet without requiring registration or matching of the respective adjoining pieces of broadloom carpet. A further demand exists for carpet that can be produced from separate dye lots and that does not require roll sequencing.

SUMMARY

This invention addresses the above-described problems by providing carpet and a method of making and or designing carpet that eliminates the need to register adjoining pieces of the broadloom carpet relative to each other. The carpet of the present invention also generally eliminates the need to match adjoining broadloom carpet pieces as to roll sequencing and dye lot.

In one aspect, the carpet of the present invention comprises a design member that is sized for a predetermined carpet web dimension. In a further aspect, the design member comprises at least one pattern member that is irregularly colorized. In another aspect, the design member of the carpet further defines a void area, which may comprise a void color. Optionally, the at least one pattern member comprises a plurality of pattern members and at least a portion of the void area of the design member is defined therebetween portions of the pattern members. The carpet can further comprise at least one line segment that at least partially partitions at least one of the pattern members. In one aspect, the at least one line segment forms a portion of the void area.

In an additional aspect, each respective pattern member can be colorized by a plurality of colors. Exemplarily, each color of the plurality of colors is formed from a predetermined combination of a plurality of yarns. In one aspect, based on the Munsell Color System, the void color differs from the plurality of colors disposed therein the pattern members in either one of, or a combination of, hue, chroma, and/or value.

In a further aspect, the carpet of the present invention further comprises a means for applying a predetermined color pattern onto the design member. The predetermined color pattern is formed from the plurality of colors and directs the colorization of each respective pattern member in the plurality of pattern members. In an exemplary aspect, the colorization of the void area is not directed by the predetermined color pattern. To irregularly color the respective pattern members, in one aspect, the color pattern is differently patterned with respect to the design member. Thus, the colors directed from the application of a color pattern can color the pattern member a single color selected from the plurality of colors or can color the pattern member a plurality of colors selected from the plurality of colors.

In one aspect, the application of color to the underlying pattern members of the design member can result in the formation of colored shapes, formed by the different directed colors of the predetermined color pattern, which do not necessarily conform to the design contours of the respective pattern members. In a further aspect, the formed "color shapes" therein the pattern members can be dispersed throughout the carpet design and may not be repeated over the entire course of the design member. Thus, the application of color thereon the pattern members of the design member via the use of the predetermined color pattern can obscure any discrete or global pattern in the resultant carpet design. It will be appreciated that the color shapes formed therein the pattern members are referring to discernable areas of color that form the color shapes.

The formed carpet having the color shapes therein the design of the pattern members of the design member can be joined at the production edge of the carpet without registration. For example, abutting broadloom carpet pieces can be joined at their respective production end edges (a butt-to-butt joint) or at their respective production side edges (a side-to side joint), without the need to align the respective design members.

In a further aspect, the height of the pile of the carpet can vary across the face of the carpet web. Varying the relative heights of the pile allows for a variation in appearance across the respective color shapes in the pattern members. In one exemplary aspect, a predetermined tufting pattern is applied to the design member such that the pile height of the carpet is varied across each of the respective pattern members. In one example, the tufting pattern is differently patterned with respect to the design member. Optionally, the tufting pattern can be designed to be differently patterned with respect to the color pattern. Alternatively, the tufting pattern can be designed to be substantially identical to the design member. In this example, the pile height would be substantially uniform across an individual pattern member irrespective of its coloration. In one exemplified embodiment, the pile height of the void area of the carpet has a substantially uniform height.

DESCRIPTION OF THE DRAWINGS

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

FIG. 2B is an enlarged partial view of the predetermined color pattern of FIG. 2A.

FIG. 15B is an enlarged partial view of the colorized design member of FIG. 15A.

DETAILED DESCRIPTION OF THE INVENTION

Figure 1:
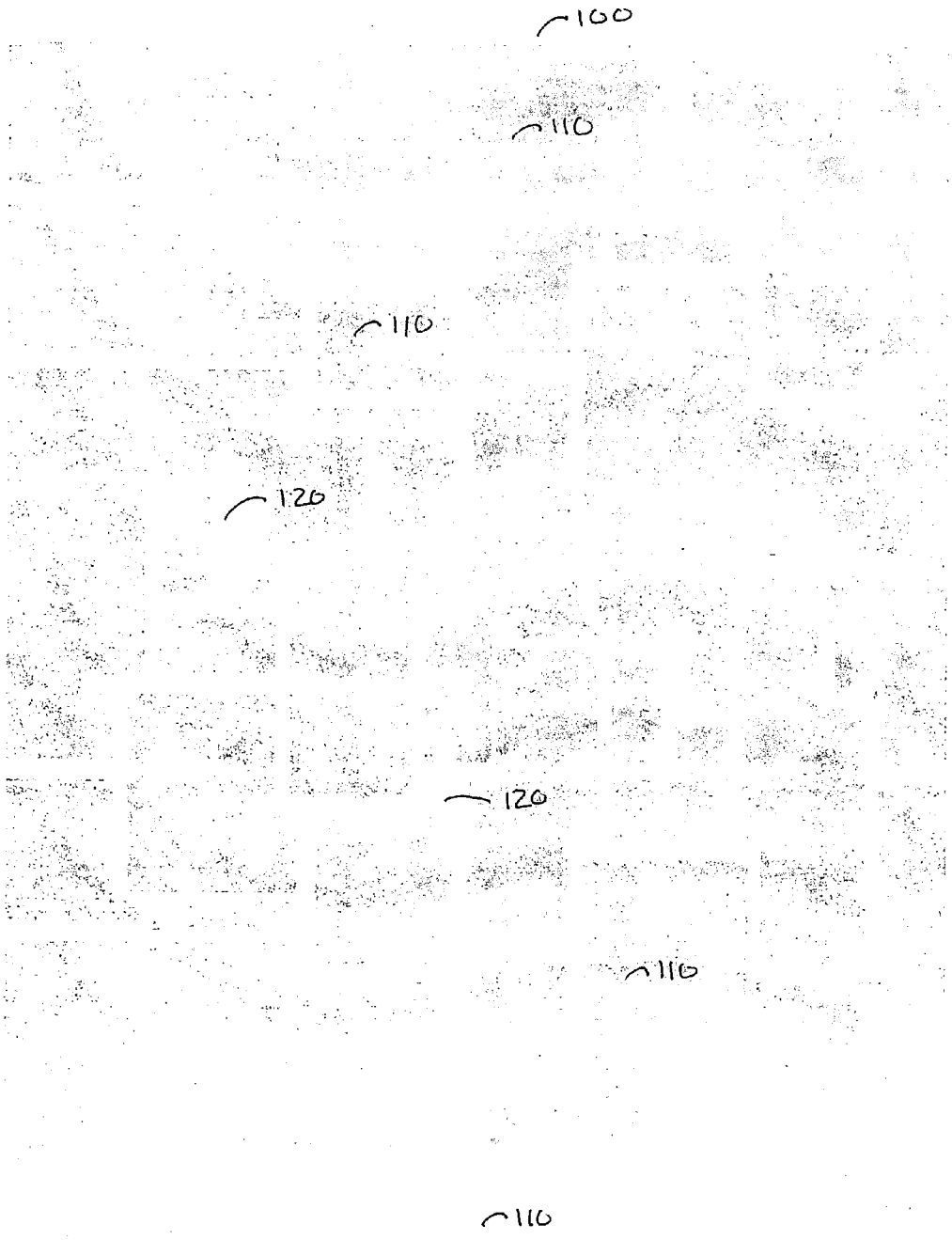
FIG. 1 is a top plan view of a design member of a carpet web produced in accordance with one embodiment of this invention, the design member showing a plurality of pattern members and defining a void area that is not colored by the application of a predetermined color pattern.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "pattern member" includes aspects having two or more such pattern members unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Referring to the figures, exemplary embodiments of a design for a carpet are illustrated. As used herein, the term "carpet" is used in its conventional sense to mean a carpet that extends over a predetermined floor area, such as, for example, a floor area extending between one vertical wall or vertical structure to the opposing vertical wall or vertical structure. The term carpet is also used herein to mean a continuous piece of material which may have conventional broadloom dimensions. The carpet of the present invention allows for the adjoining of the respective carpet pieces at their respective edge surface to span the predetermined floor area. The term carpet is also used in its conventional sense to mean a carpet that is, for example and without limitation, either tufted or woven.

As used herein, the definition of the terms "hue," "chroma," and "value" are referenced in terms of the Munsell Color System. In the Munsell Color System "hue" is defined as one of the three attributes of color that distinguishes red from green, blue from yellow, and so forth. "Chroma" is the attribute of color used to indicate the degree of departure from a gray of the same value "Value" is an attribute of color that indicates the lightness of an object viewed in daylight on a scale of from "0" for the ideal black to "10" for the ideal white.

The carpet 10 of the present invention comprises a design member 100 that is sized for a predetermined carpet web dimension. The design member 100 comprises at least one pattern member 110 or, optionally, a plurality of pattern members. Each pattern member is colorized. In various aspects, each individual pattern member 110 can be colored with one color or can be colored with at least two colors selected from a plurality of colors. The design member further defines a void area 120. As used herein, the term "void area" is used to refer to areas across the carpet web that have a substantially uniform color, i.e., the "void color," and a substantially uniform height. The void area can be defined in a designed space therebetween at least some of the pattern members.

The carpet 10 can further comprise at least one line segment 140 or a plurality of line segments that at least partially partitions at least one of the pattern members 110. In one aspect, the at least one line segment forms a portion of the void area. In this aspect, the carpet has a production axis P and each line segment extends substantially parallel to the production axis. It is contemplated that the line segments 140 can be substantially linear. In one aspect, the plurality of line segments can vary in a width dimension that is substantially transverse to the production axis. In a further aspect, the spacing between adjacent line segments of the plurality of line segments can vary in a width dimension substantially transverse to the production axis.

In another aspect, each individual pattern member 110 can have a plurality of line segments 140 defined therein. It is contemplated that the line segments positioned within the individual pattern members can vary in the transverse width dimension. Further, the spacing between the line segments positioned within the individual pattern members can vary in the transverse dimension. It is further contemplated that the relative width and spacing of the line segments positioned therein the pattern members can vary between the respective pattern members.

As noted above, each respective pattern member 110 is colorized by colors selected from the plurality of colors 210. Exemplarily, each color of the plurality of colors is formed from a predetermined combination of a plurality of yarns. In one aspect, based on the Munsell Color System, the void color differs from the plurality of colors therein the pattern members in either one of, or a combination of, hue, chroma, and/or value. In one exemplary aspect, at least one of the yarns forming the void color differs from the plurality of yarns that form the plurality of colors. In another aspect, all of the yarns used in the void color differ from the plurality of yarns that form the plurality of colors.

In one exemplary embodiment, the plurality of yarns can comprise a thread-up of at least 2 yarns, alternatively, a thread-up of at least 3 yarns, and alternatively a thread-up of at least 4 yarns. Colors may be varied by the different combinations of thread yarns that are brought to the surface during conventional tufting. Thus, in one example and not meant to be limiting, a 4 yarn thread-up, ABCD, allows the formation of colors that include, but are not limited to, the following:

A high, BCD low
B high, ACD low
C high, ABD low
D high, ABC low
AB high, CD low
AC high, BD low
AD high, BC low
BC high, AD low
BD high, AC low
CD high, AB low
ABC high, D low
BCD high, A low
ACD high, B low
ABD high, C low Thus, one will appreciate that a multitude of available colors are available for inclusion in the carpet of the present invention with a simple, repetitive thread-up of a conventional tufting machine, i.e., a repeated ABCD thread-up across the width of the needle bar. Any type of yarn can be used, for example and not meant to be limiting, space dyed yarn, single color yarns, barber pole yarns, and the like. Of course, any combination of types of yarns can be used in the thread-up. Further, yarn from different dye lots may be used in the thread-up.

The carpet 10 of the present invention further comprises a means for applying a predetermined color pattern 200 onto the design member 100. The predetermined color pattern 200 is formed from the plurality of colors 210 and directs the colorization of each respective pattern member 110 in the plurality of pattern members. As noted above, the colors that comprise the plurality of colors can be derived from the color combination of the yarn thread-up. It is contemplated that all or only some portion of the available colors can be used in the preparation of the design of the color pattern. However, it will be appreciated that the void color is not directed by the predetermined color pattern 200.

In one exemplary aspect, to color the pattern member, the predetermined color pattern 200 is differently patterned with respect to the design member 100. Thus, it is contemplated that the colors directed from the predetermined color pattern can color a respective pattern member 110 a single color selected from the plurality of colors 210 or can color the same pattern member a plurality of colors selected from the plurality of colors.

In one aspect, due to the application of a predetermined color pattern that is designed to not register with the design layout of the pattern members 110 of the underlying design member 100, the color or colors disposed therein the respective pattern members cause the formation of color shapes 115 formed by the different directed colors within the pattern members. Further, the formed color shapes 115 therein the pattern members are typically dispersed throughout the carpet design and may not be repeated over the entire course of the design member. Thus, the application of color to pattern members of the carpet obscures any discrete and/or global pattern in the resultant carpet design.

The irregular color shapes formed therein the pattern members are referring to the areas of color that form the color shapes. It is further contemplated that the formed color shapes have no required characteristics. The formed size and shape of the color shapes 115 are constrained by a combination of the size and shape of the respective pattern members 110 and the design of the predetermined color pattern 200. The varying color shapes defined within the respective pattern members contributes to the quality of the design of the carpet web that eases installation of the formed carpet broadloom pieces.

In another aspect, the predetermined color pattern 200 can comprise a plurality of predetermined color patterns. In one aspect, each predetermined color pattern can have a common orientation axis and, in this aspect, it is preferred that each predetermined color pattern of the plurality of predetermined color patterns is substantially different when they are viewed with respect to their common orientation axis. In one example, each predetermined color pattern is different with respect to the other predetermined color patterns of the plurality of color patterns. In this aspect, the differing predetermined color patterns 200 can be successively applied to the underlying design member 100 to direct the colorization of the pattern members. In this aspect, each differing respective color pattern directs the colorization of at least one predetermined pattern member. In another aspect, the differing color patterns are successively applied to the design member until all of the pattern members are colorized.

In another aspect, the pile height of carpet can vary across the face of the carpet web. Varying the relative heights of the pile of the carpet allows for a variation in appearance across the respective color shapes 115 in the pattern members 110. In one exemplary aspect, a predetermined tufting pattern 300 can be applied to the design member such that the pile height of the carpet is varied across each of the respective pattern members. Optionally, in varying aspects, the predetermined tufting pattern 300 can be differently patterned with respect to the design member 100. In a further aspect, the predetermined tufting pattern can be designed to be differently patterned with respect to the predetermined color pattern 200.

Optionally, the predetermined tufting pattern 300 can be designed to be substantially identical to the design of the pattern members 110 of the design member 100 such that the pile height of the carpet 10 would be substantially uniform across each individual pattern member. In this example, each respective pattern member would have a designated substantially uniform pile height that can differ from the pile height of other pattern members within the design member. In another aspect, it is contemplated that the pile heights of individual pattern members can vary across the face of the carpet.

In a further aspect, the pile height of the carpet 10 forming the void area 120 can have a substantially uniform height and is unaffected by the application of the predetermined tufting pattern 300. In yet another aspect, the pile height of the void area 120 can have a height that is less than the height of the pile that forms the respective color shapes therein the pattern members 110 of the design member.

Figure 2A:
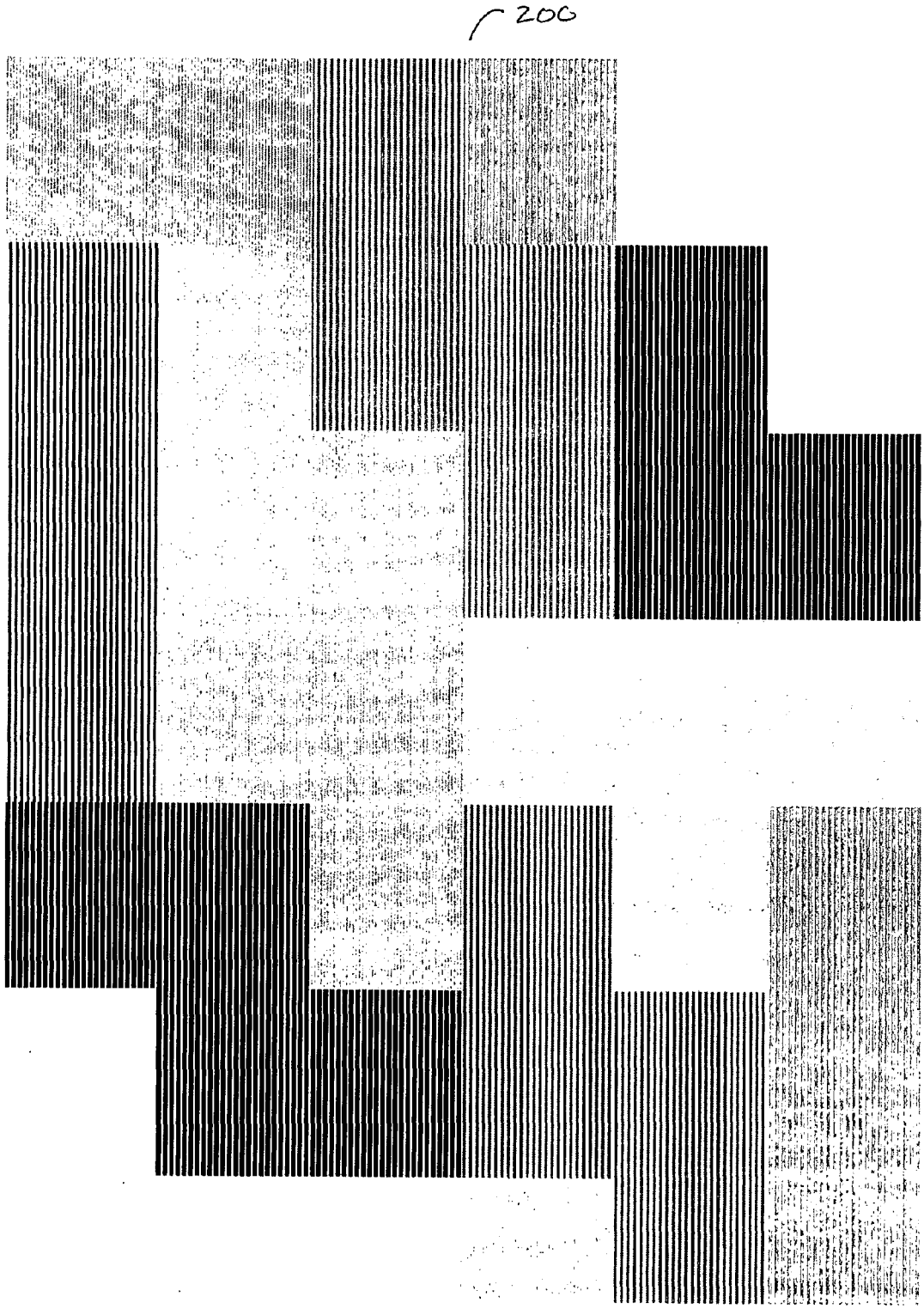
FIG. 2A is a top plan view of a predetermined color pattern having a plurality of colors dispersed in a predetermined pattern thereon and showing a plurality of line segments oriented in a direction parallel to a production axis of the carpet web, the plurality of line segments defining blank areas that are not colored by the plurality of colors within the predetermined color pattern.
Figure 23:
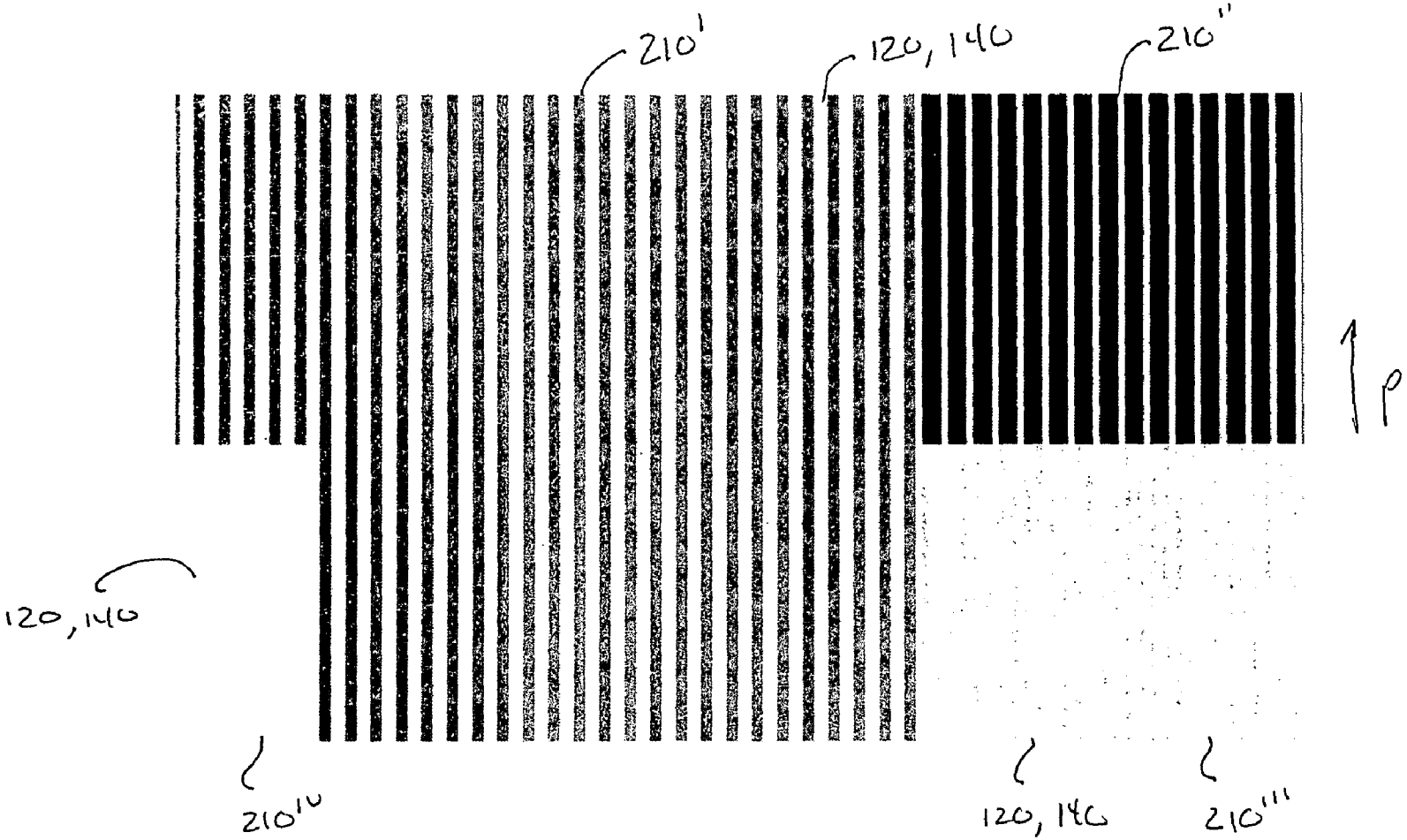
Figure 3:
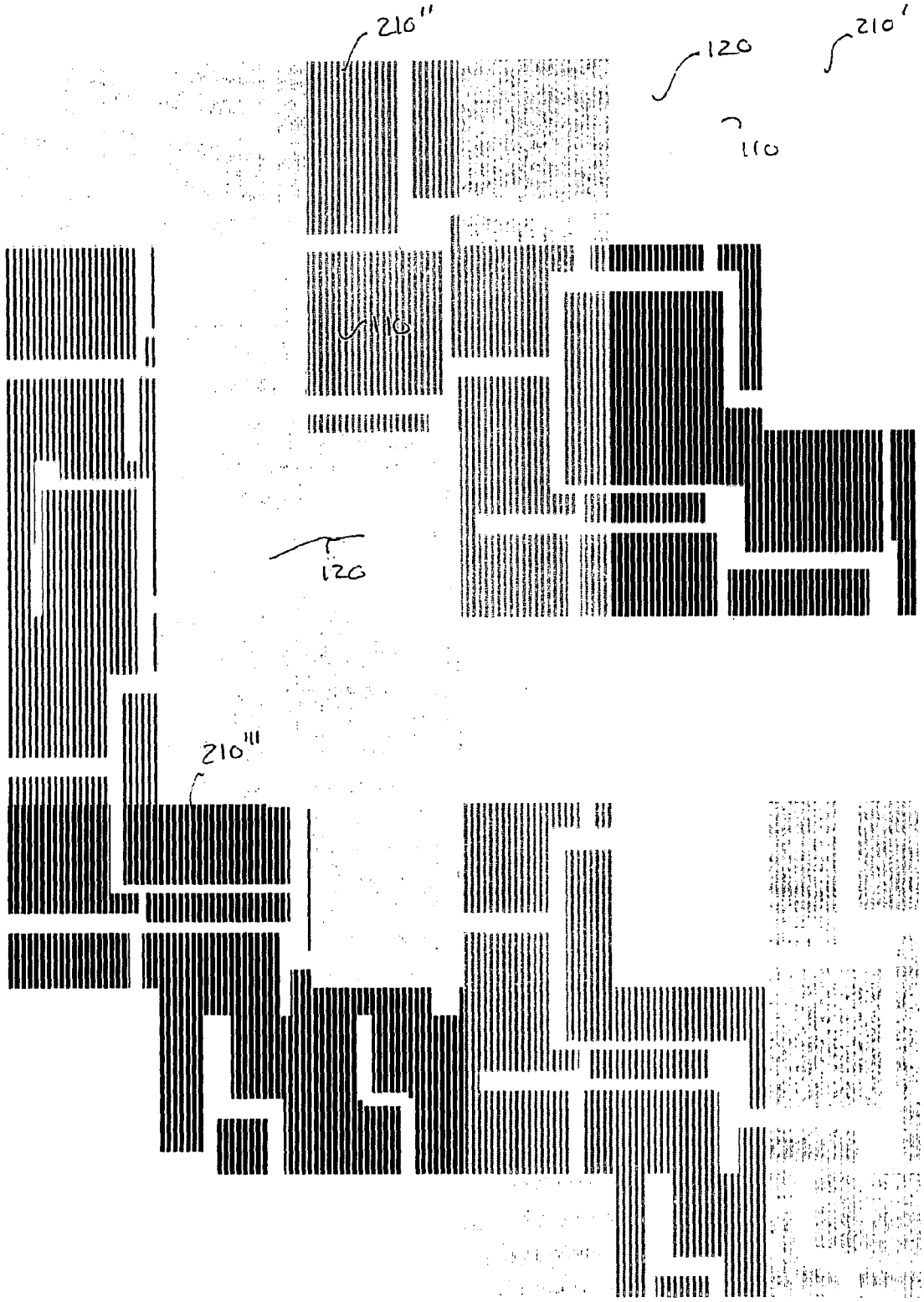
FIG. 3 is a top plan view of the design member of FIG. 1, after the predetermined color pattern of FIG. 2 is overlaid thereon, and showing the line segments forming a portion of the void area of the carpet web.

Referring to FIGS. 1-7, a first example of a carpet web of the present invention is shown. In FIG. 1, an exemplified design member is shown having a plurality of pattern members and defining the void area that will not be colorized by the application of the predetermined color pattern. A predetermined color pattern is shown in FIG. 2. This exemplified color pattern uses 11 different colors from the plurality of colors in a grid-like color pattern. In this example, particular line segment arrays are formed in each different color section of the color pattern. Each line segment is oriented in a direction parallel to the production axis P of the carpet web and defines a plurality of line segments that define blank areas that are not colored by the plurality of colors within the predetermined color pattern. In another aspect, when the single predetermined color pattern is overlaid onto the design member, and as shown in FIG. 3, portions of the pattern members are colorized to form the discrete color shapes. Further, the elements of the void area, including the line segments, are shown.

Figure 4:
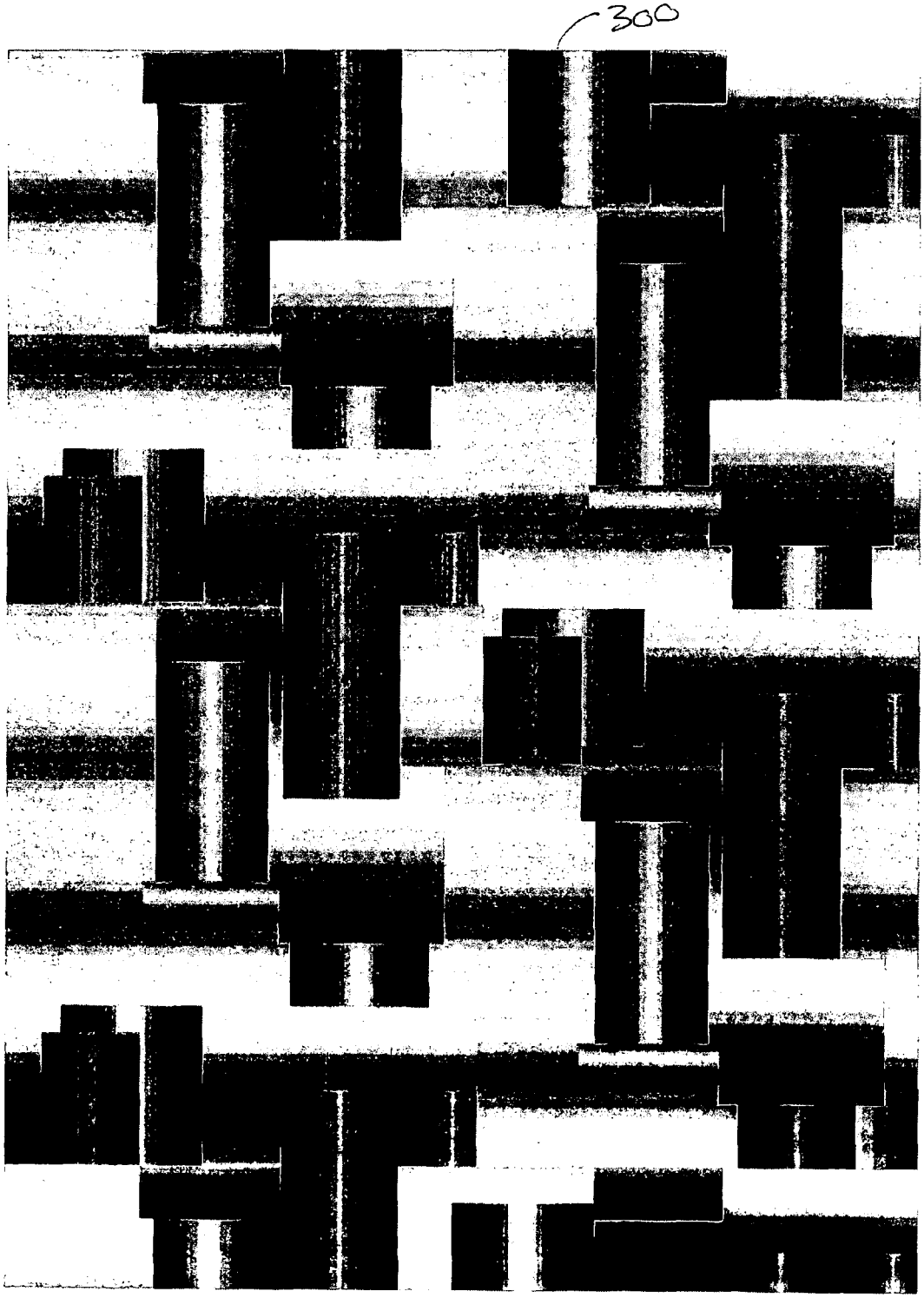
FIG. 4 is a top plan view of a predetermined tufting pattern, which, in this exemplified embodiment, has fourteen different pile heights across the face of the tufting pattern. In this figure, each respective color on the tufting pattern is indicative of a predetermined pile height.
Figure 5A:
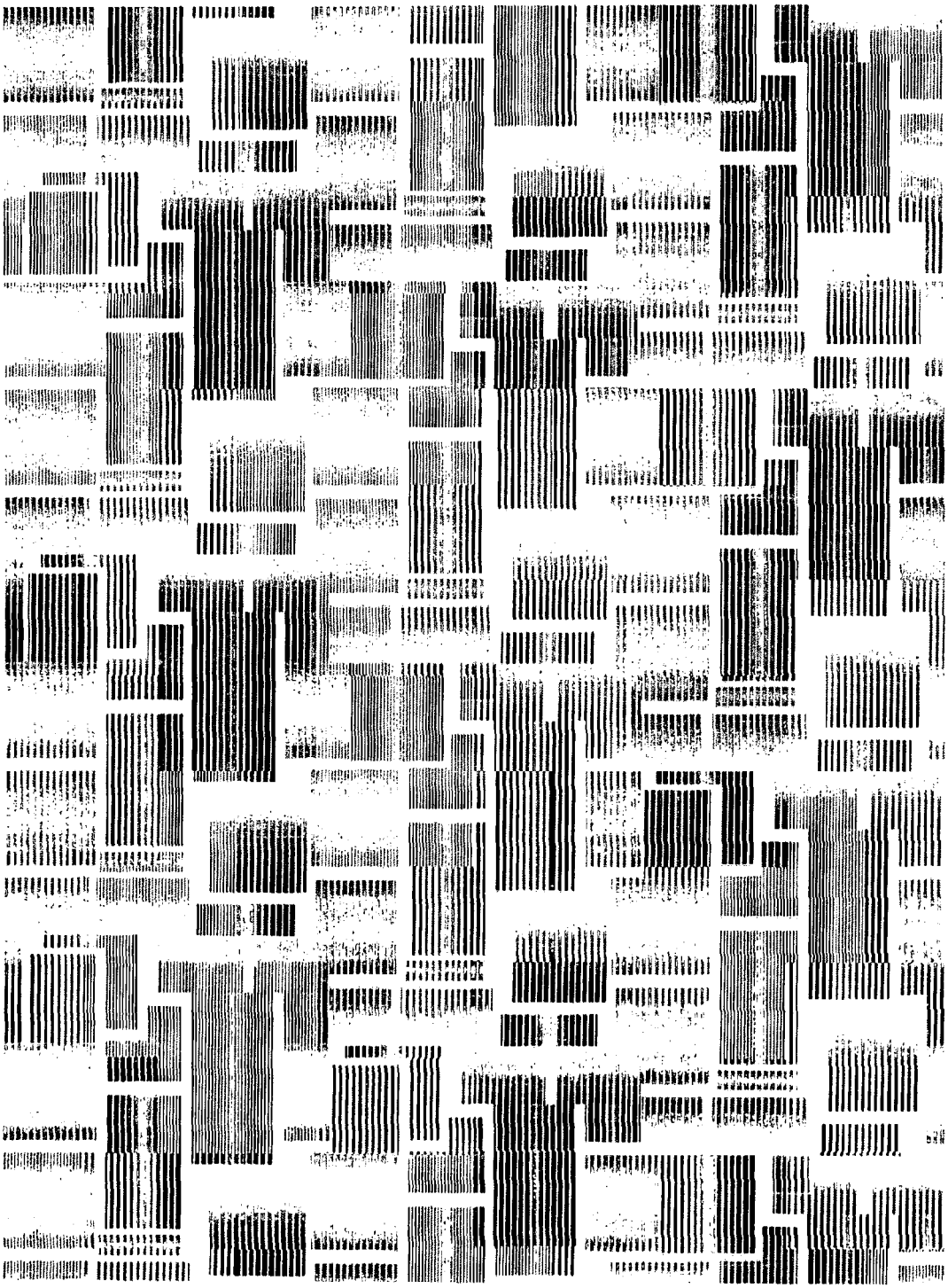
FIG. 5A is a top plan view of the carpet web after the predetermined tufting pattern of FIG. 4 is overlaid thereon the colorized design member of FIG. 3, the void area elements having a predetermined color and a substantially uniform pile height that are unaffected by the application of the predetermined color pattern and the predetermined tufting pattern.
Figure 5B:
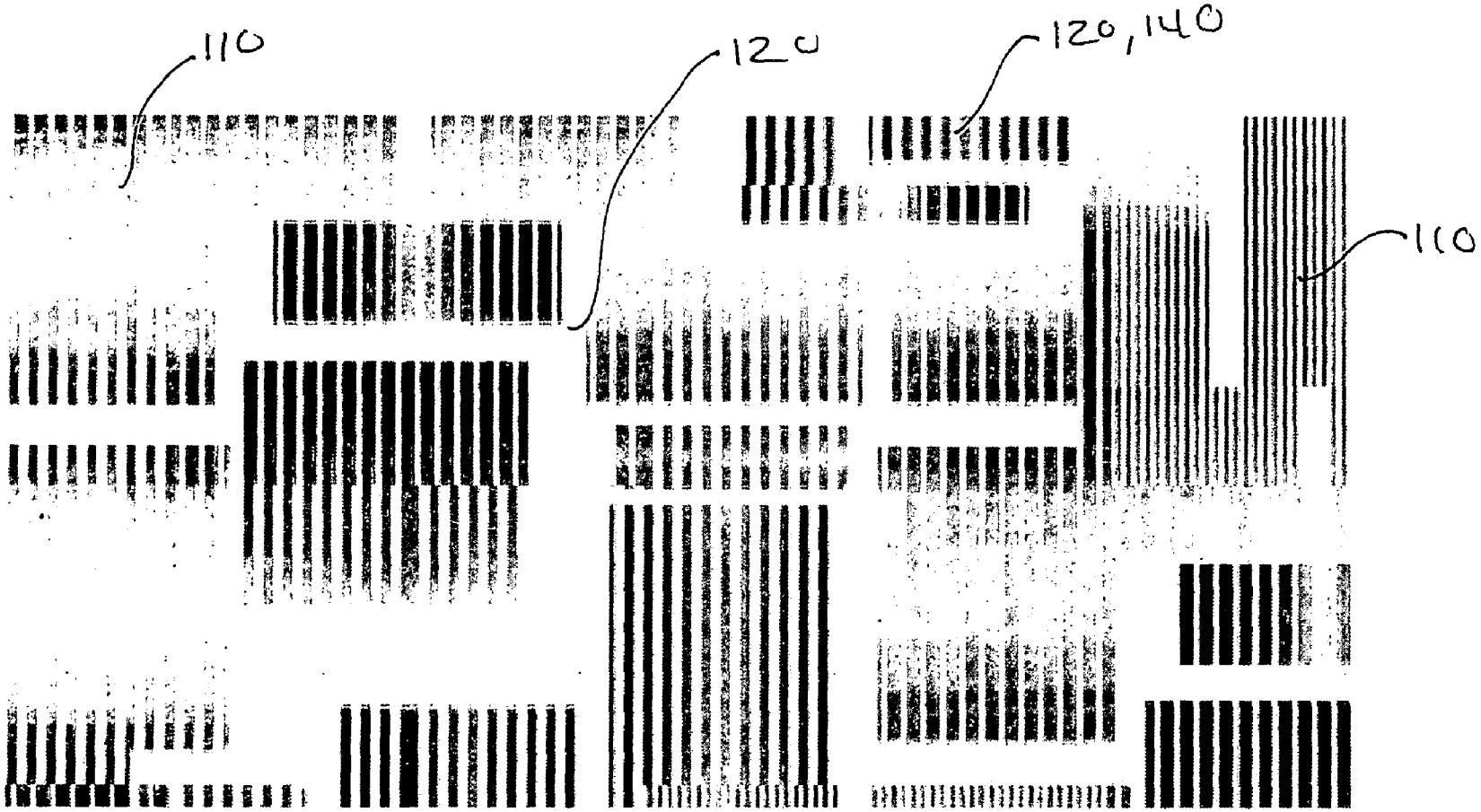
FIG. 5B is an enlarged partial view of the carpet web of FIG. 5A in which each respective color tone is indicative of a combination of a respective color and a respective pile height.
Figure 6:
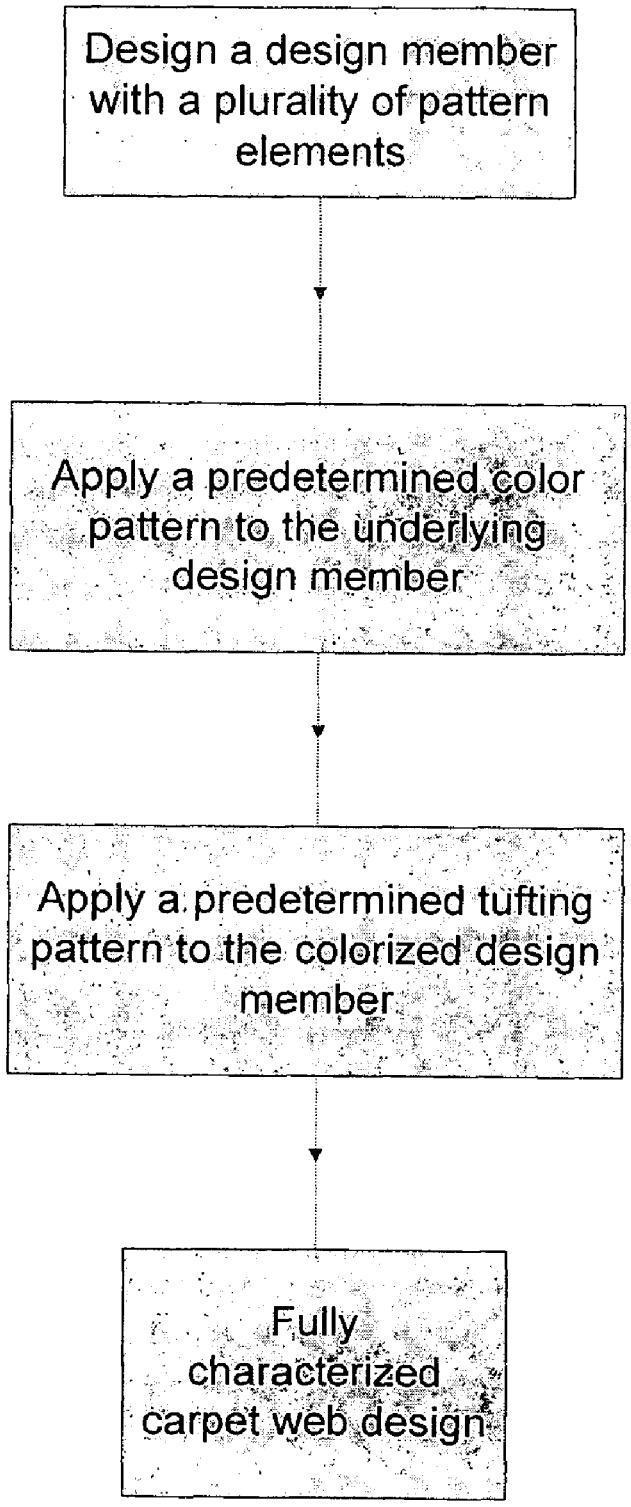
FIG. 6 is an exemplified flowchart of the process of forming the carpet web of FIG. 5A.

This exemplary construction includes the use of a predetermined tufting pattern. As shown in FIG. 4, the predetermined tufting pattern is different with respect to the design member and the predetermined color pattern. In this exemplified embodiment, the predetermined tufting pattern has fourteen different pile heights across the face of the tufting pattern (as shown by the varying colors of the predetermined tufting pattern. When the predetermined tufting pattern of FIG. 4 is overlaid thereon the colorized design member of FIG. 3, the carpet web design is fully characterized with respect to color, color shapes, and pile height as shown in FIGS. 5A and 5B. In this example, the void area has a predetermined color and a substantially uniform pile height and are unaffected by the application of the predetermined color pattern and the predetermined tufting pattern. A carpet web manufactured in accord with this example is shown in FIG. 7.

Figure 7:
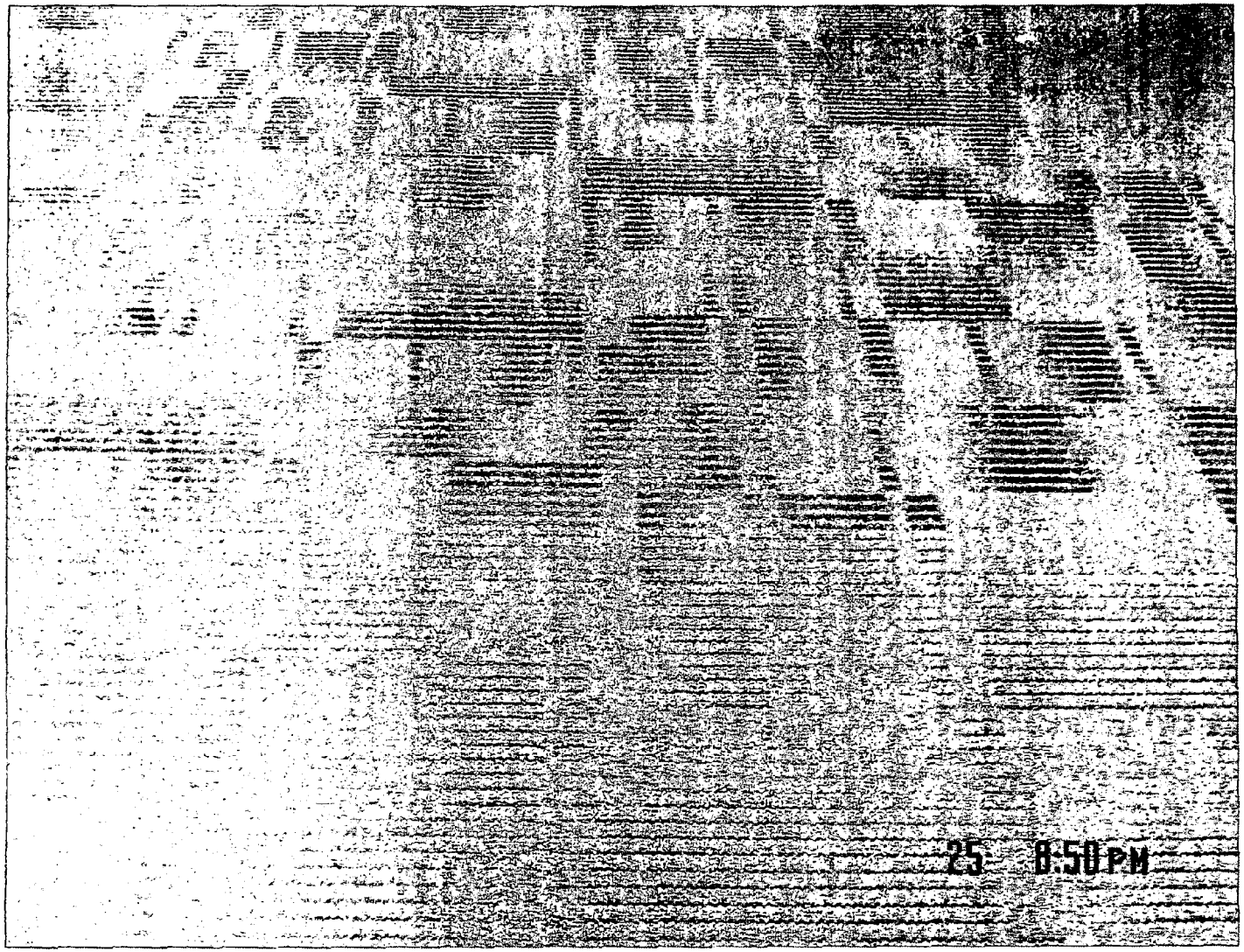
FIG. 7 is a perspective photograph of the carpet web of FIG. 5A being produced.
Figure 8A:
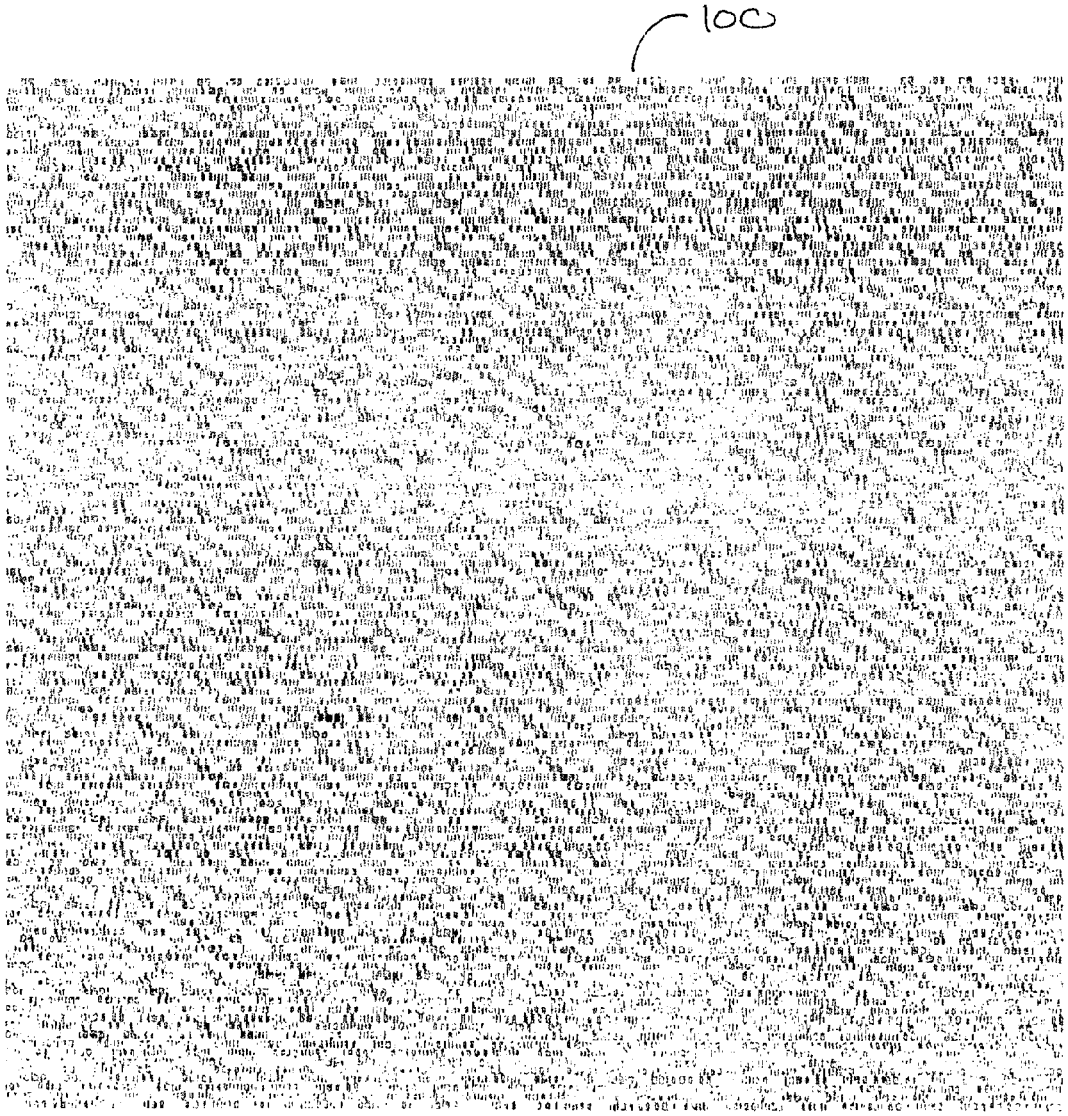
FIG. 8A is a top plan view of a design member of an alternative embodiment of a carpet web produced in accordance with one embodiment of this invention, the design member showing a plurality of pattern members and defining a void area comprising a plurality of line segments oriented in a direction parallel to a production axis of the carpet web, the void area defining blank areas that are not colored by the plurality of colors within an overlaid predetermined color pattern.
Figure 8B:
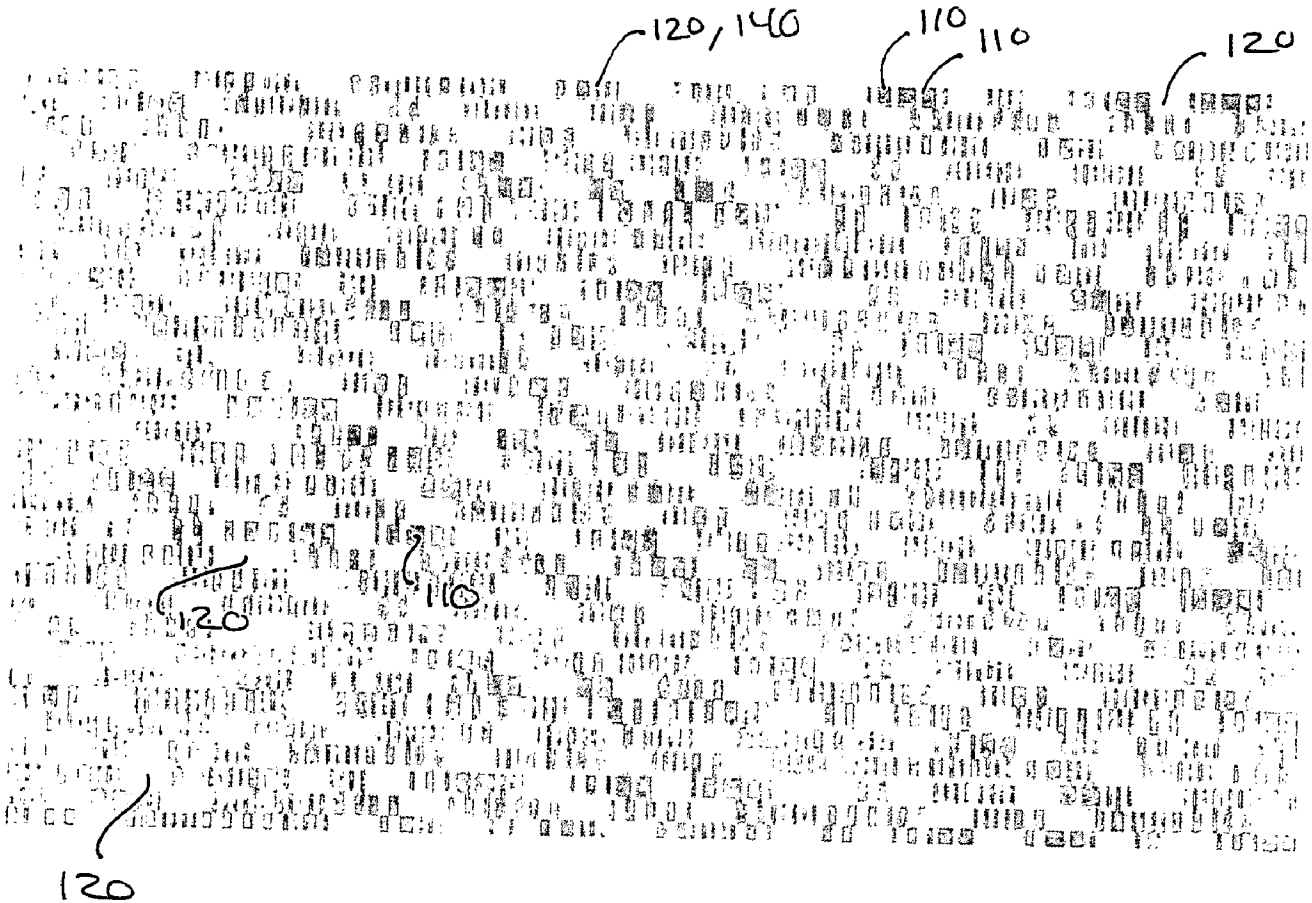
FIG. 8B is an enlarged partial view of the design member of FIG. 8A.

The carpet web shown in FIG. 7 may be formed by a conventional carpet tufting machine. For example, a tufting machine having two bars of needles may be used. The carpet web may be, but does not have to be, manufactured using a conventional carpet tufting machine. Among other alternatives, and not meant to be limiting, the carpet web may be produced on a carpet tufting machine having ¼ gauge and ⅛ gauge needle bars. The desired pattern design (and full and partial repeats thereof, if desired) may be formed on the carpet web by controlling the height of the yarn tufts and the "thread-up" of the machine, i.e., the arrangement of yarn colors dedicated to the needles of the machine.

Each needle is threaded with a dedicated yarn type (e.g., single color, space dyed, barber pole, etc.) and color(s). In one example, the color shapes of the pattern members are formed on the color web by contrast between adjacent yarn colors on a single needle row and by contrast between the yarn colors on the first needle bar and the second needle bar. Thus, the types and colors of yarn used should be selected to achieve a desired contrast between areas of the pattern. For example, normally at least two colors must be used to achieve the desired color contrast. However, it is optional, but not necessary, to use more than two colors to achieve the desired color contrast. For example, the void color should differ from the plurality of colors therein the pattern members in either one of, or a combination of, hue, chroma, and/or value. In one exemplary aspect, at least one of the yarns forming the void color differs from the plurality of yarns that form the plurality of colors. In a further exemplary aspect, all of the yarns used in the void color differ from the plurality of yarns that form the plurality of colors.

Any thread-up of the machine may be used in accordance with this invention so long as the resultant web forms a carpet in accord with the directed color and texture design. In an example of a thread-up that uses a variety of colors to create the carpet web shown in FIG. 7, the first bar of needles is threaded to form the void color that is present across the entire carpet web. In this example, the thread up of the first bar of needles uses a three yarn thread up (ABC), which is repeated across the length of the first bar. The thread-up of the second bar of needles uses a four yarn thread-up (EFGH) that is also repeated across the length of the second needle bar. In this example, the colors of the respective yarns forming the void area differ from the colors of the respective yarns forming the color shapes. While, as explained above, any type of yarn may be used, the needles of the first needle bar forming the void color are threaded with space dyed and solid color yarns in this example.

As noted above, the characteristic of the formed carpet web can be further controlled by varying the height of the yarn, i.e., controlling the pile height of the carpet web. The longer the length of yarn that is pushed through the primary backing, the greater its height in the finished carpet. In the exemplary carpet web, the void color has a substantially uniform height across the design member, so that at least some void area yarn is visible in all areas of the pattern, and some areas show only void area yarn.

As noted, in this example, the void color is tufted over the entirety of the carpet web at a substantially uniform height. The needles of the second bar dictate the height of the respective tufts of yarn to comport with the overlaid color pattern(s) and tufting pattern(s). One skilled in the art will appreciate that, if only the void color is supposed to be visible, the yarn being stitched by the second bar will be buried underneath the void color.

To create design elements in the pattern during the manufacturing process, one or more of the needle bars may be, but do not have to be, shifted during tufting. For example, a gauged needle bar, such as a ¼ gauge needle bar, can be subjected to an exemplary 3×3×1 shift during tufting. In a 3×3×1 shift, the needles penetrate twice, the bar shifts to the right one gauge (i.e., ¼ of an inch if the ¼ gauge bar is shifting), the needles penetrate twice, the bar shifts to the right one gauge, the needles penetrate twice, the bar shifts to the right one gauge, the needles penetrate twice, the bar shifts to the left one gauge, the needles penetrate twice, the bar shifts to the left one gauge, the needles penetrate twice, the bar shifts to the left one gauge, and the needles penetrate twice. At this point, the needles are back in their initial position relative to the web. This lateral shifting allows for the introduction of elements into the pattern by creating a snake-like or serpentine pattern on the web. The needle bar can be shifted in any number of sequences to alter the pattern formed on the carpet web in order to comport to the final design of the carpet.

FIGS. 8A-12B show a design of a carpet web in accordance with an alternative embodiment of the invention. In this design, the plurality of pattern members defines the void area portion of the design member. The void area portion is designated to not be irregularly colored by the application of the predetermined color pattern. In this example, the void area defined in the design member comprises the plurality of line segments that are oriented in a direction parallel to a production axis of the carpet web.

Figure 9A:
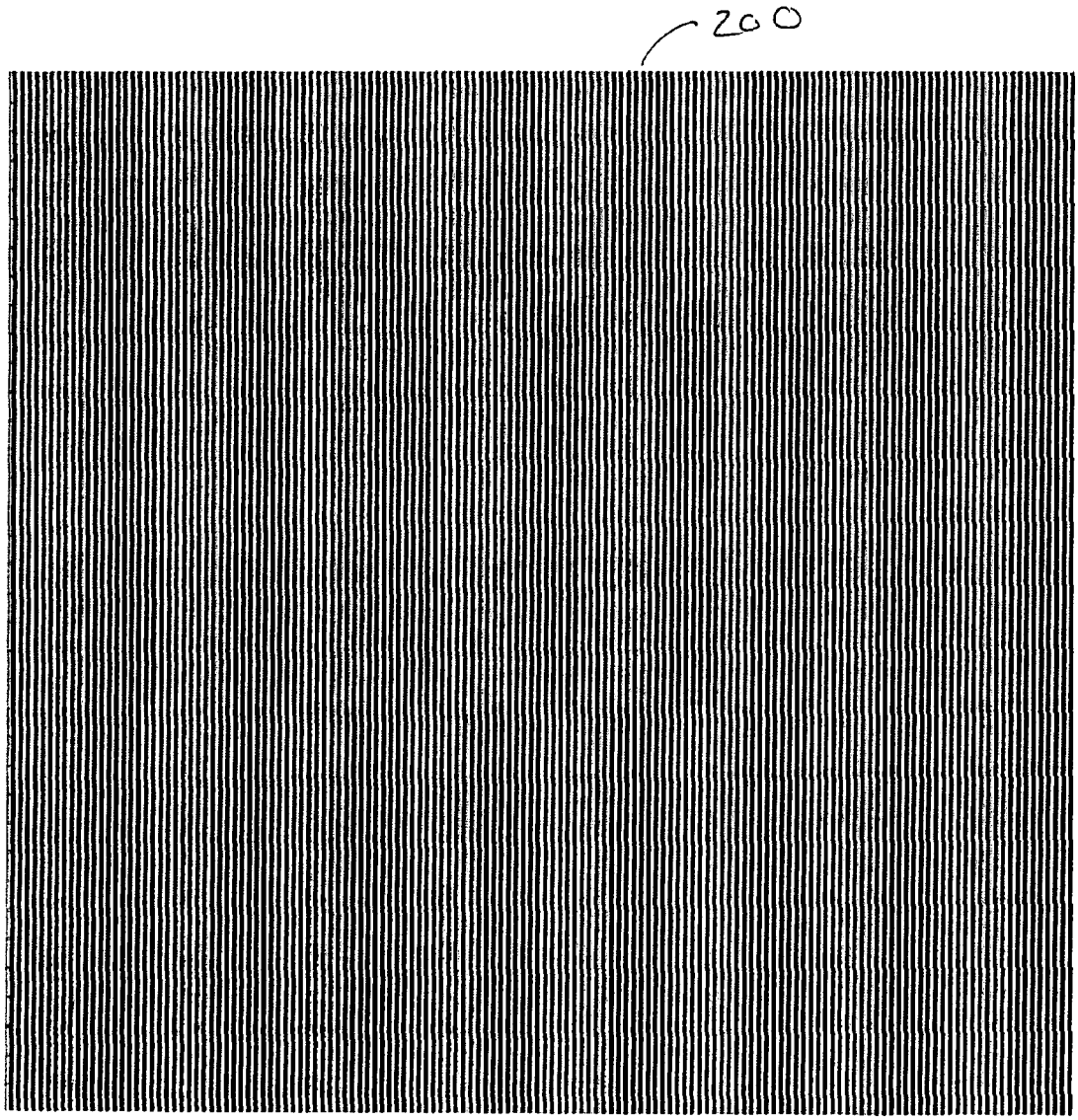
FIG. 9A is a top plan view of a predetermined color pattern having a plurality of colors dispersed in a predetermined pattern thereon.
Figure 9B:
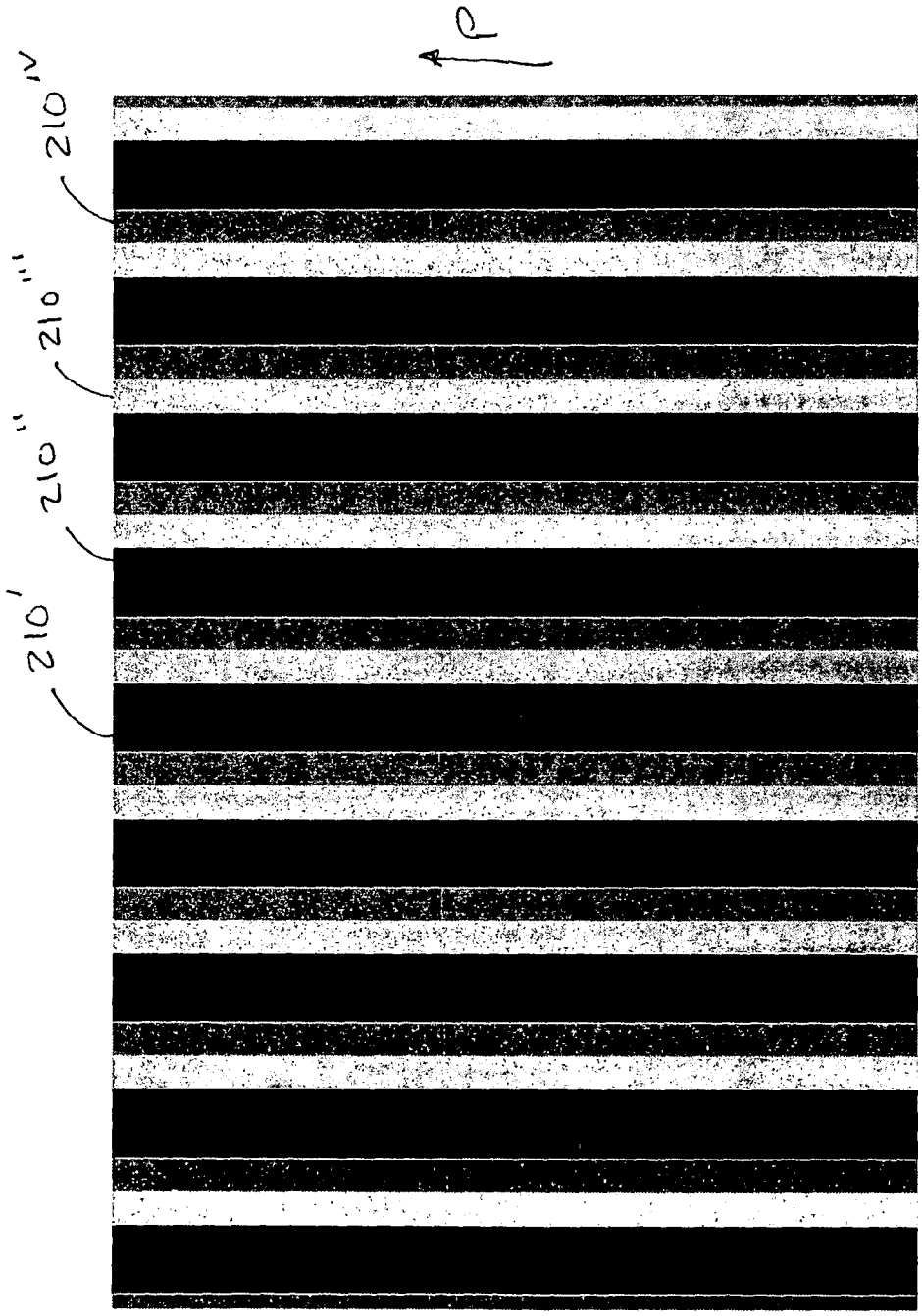
FIG. 9B is an enlarged partial view of the predetermined color pattern of FIG. 9A.
Figure 10A:
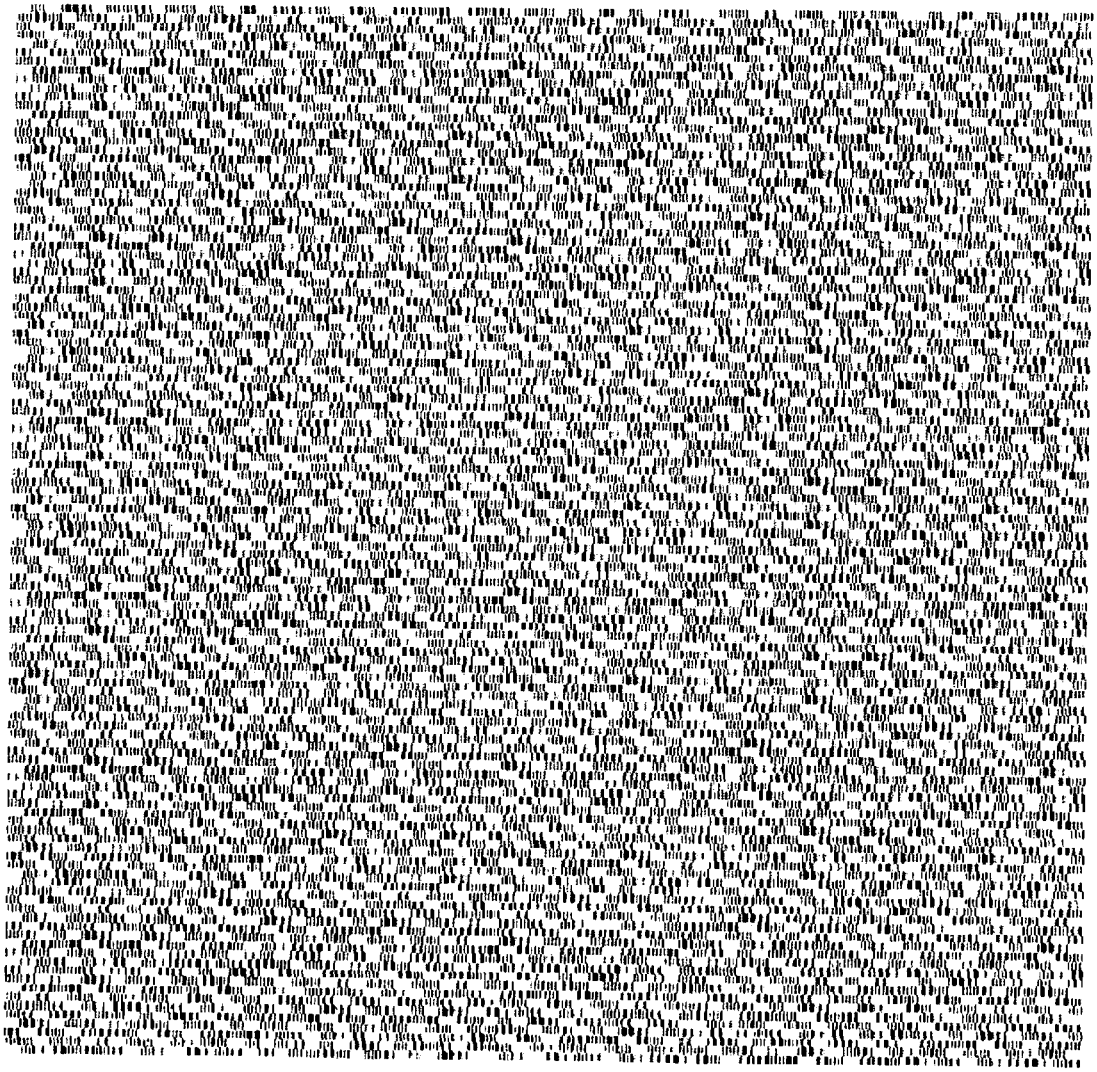
FIG. 10A is a top plan view of the design member of FIG. 7A, after the predetermined color pattern of FIG. 9A is overlaid thereon, and showing the line segments forming a portion of the void area of the carpet web.
Figure 10B:
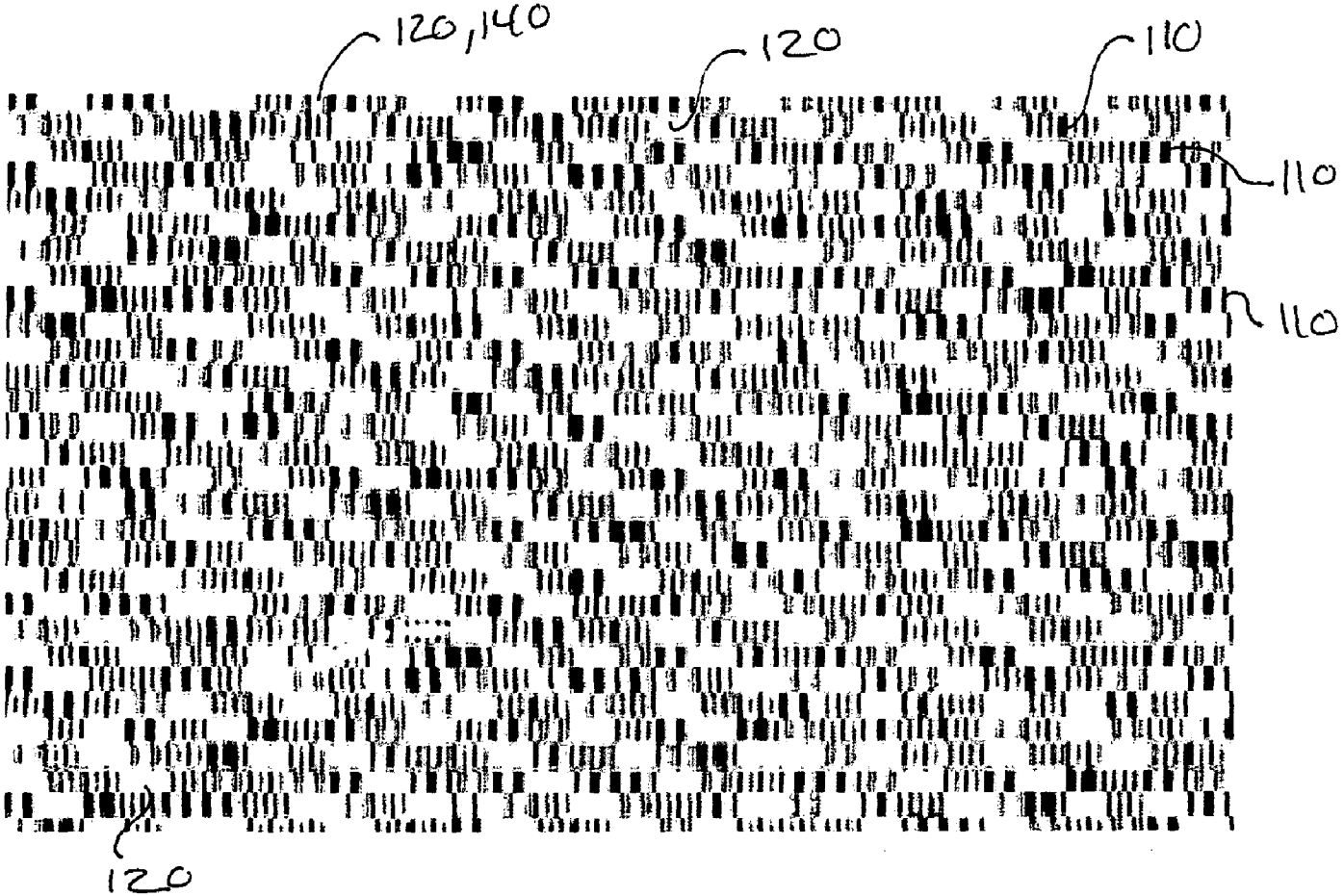
FIG. 10B is an enlarged partial view of FIG. 9A, showing the colorized pattern members of the design member.

As shown in FIGS. 9A and 9B, the predetermined color pattern used in this example comprises four colors dispersed thereon in a predetermined pattern. The exemplified pattern is a plurality of stripes running substantially parallel to the machine production direction. When the predetermined color pattern is overlaid onto the design member, as shown in FIGS. 10A and 10B, portions of the pattern members are colorized to form the discrete color shapes. As described above, the elements of the void area, including the line segments, are not colored by the application of the predetermined color pattern.

Figure 11A:
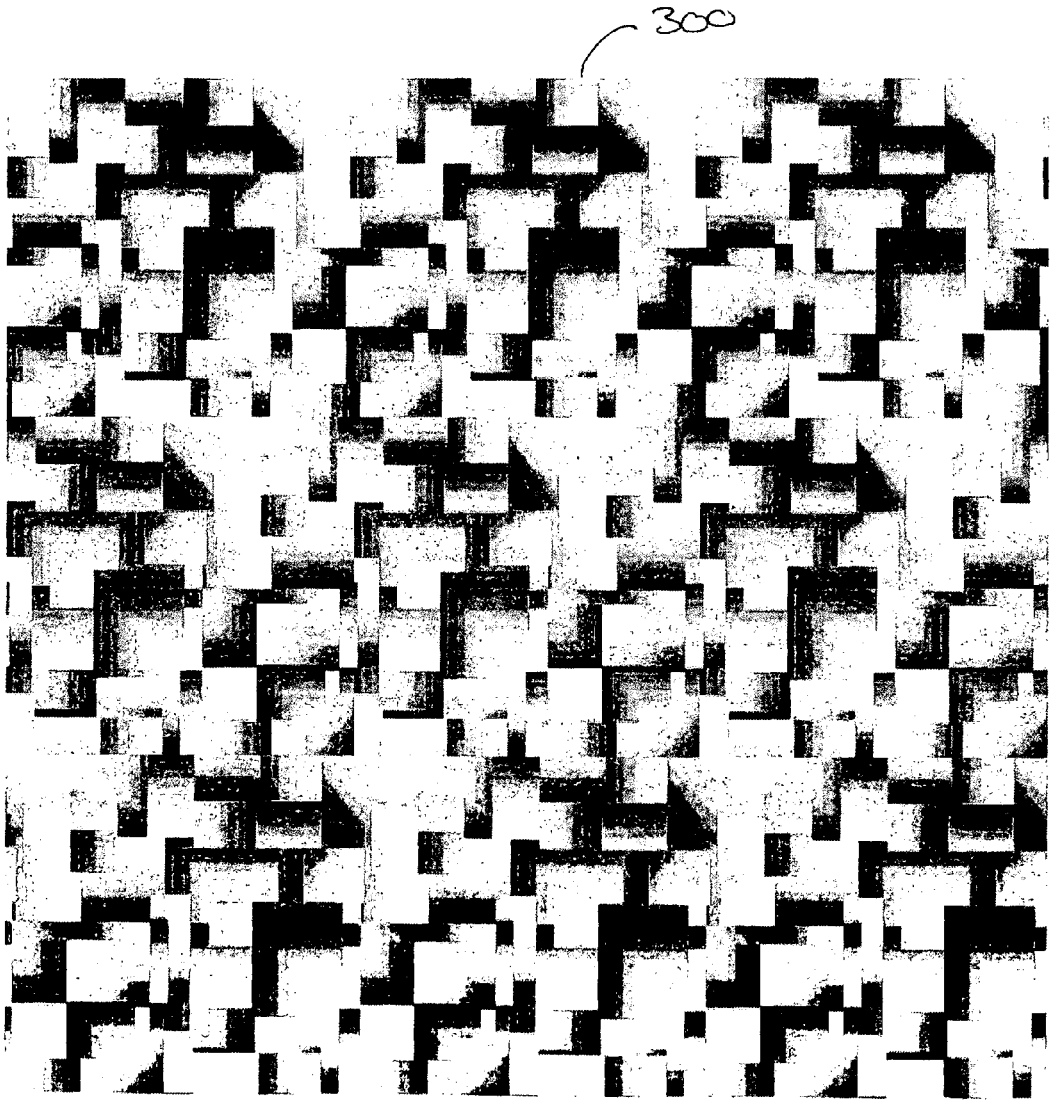
FIG. 11A is a top plan view of a predetermined tufting pattern, which, in this exemplified embodiment, has ten different pile heights across the face of the tufting pattern. In this figure, each respective color on the tufting pattern is indicative of a predetermined pile height.
Figure 11B:
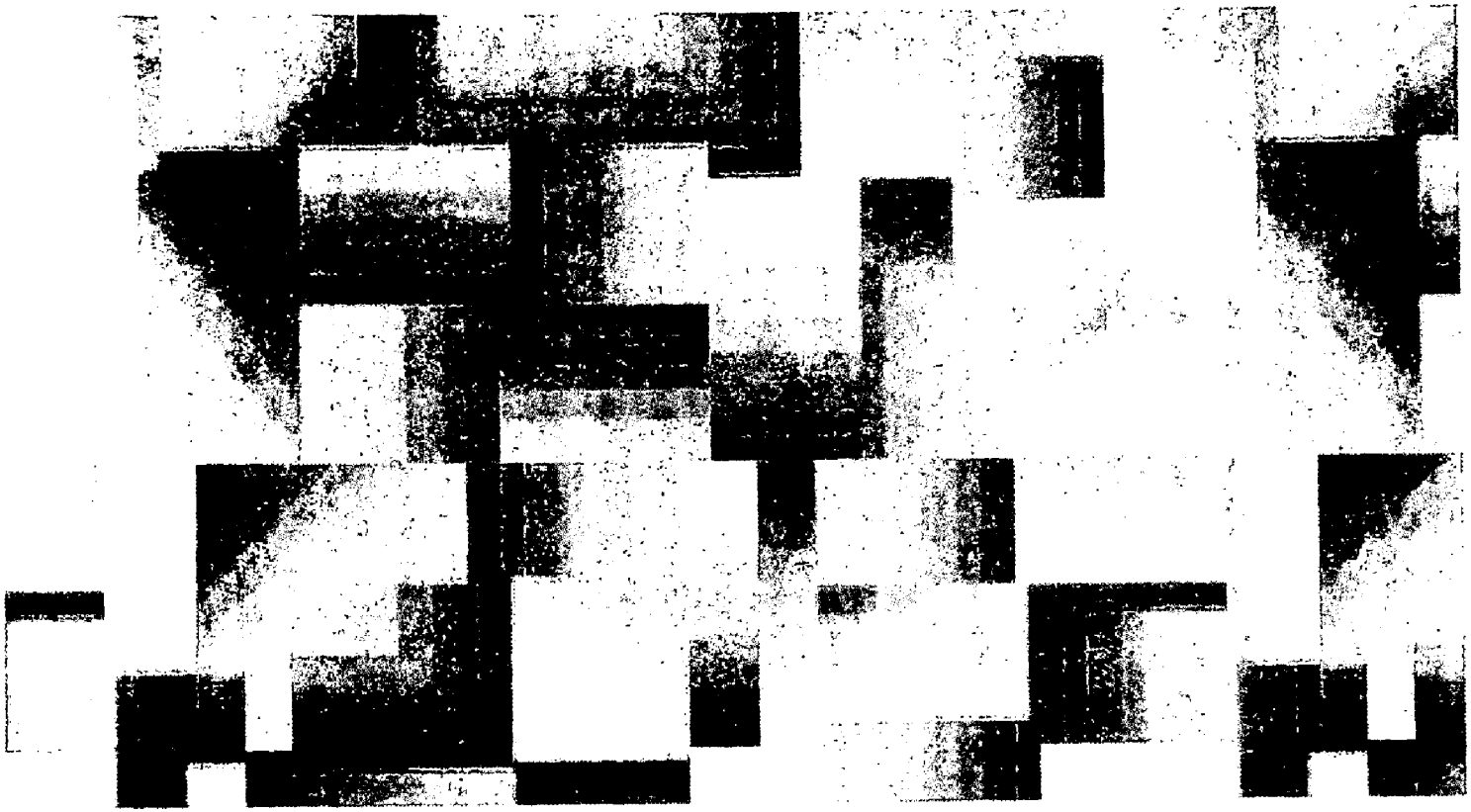
FIG. 11B is an enlarged partial view of the predetermined tufting pattern of FIG. 11A.
Figure 12A:
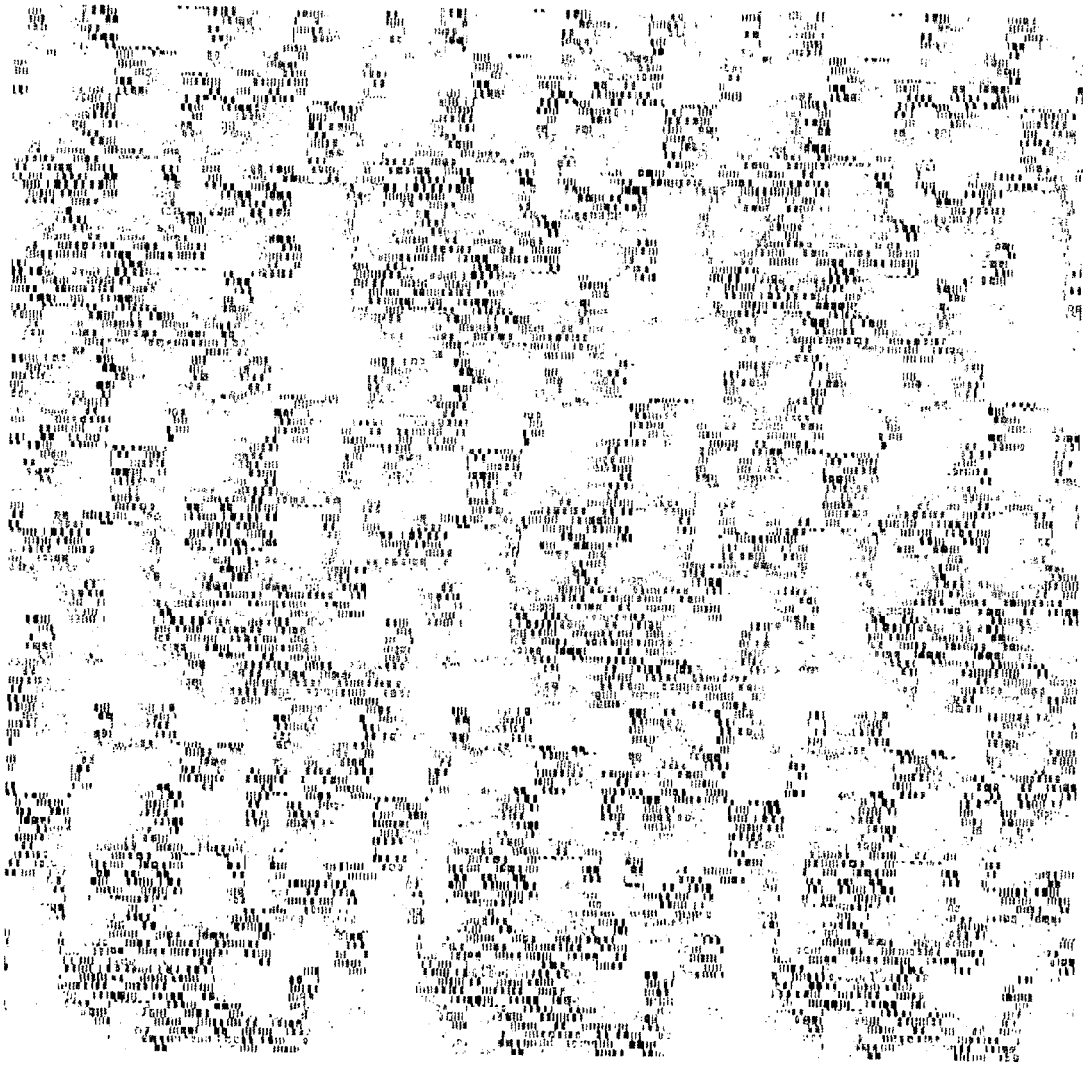
FIG. 12A is a top plan view of the carpet web after the predetermined tufting pattern of FIG. 11A is overlaid thereon the colorized design member of FIG. 10A, in which the elements of the void area have a predetermined color and a substantially uniform pile height that are unaffected by the application of the predetermined color pattern and the predetermined tufting pattern.
Figure 12B:
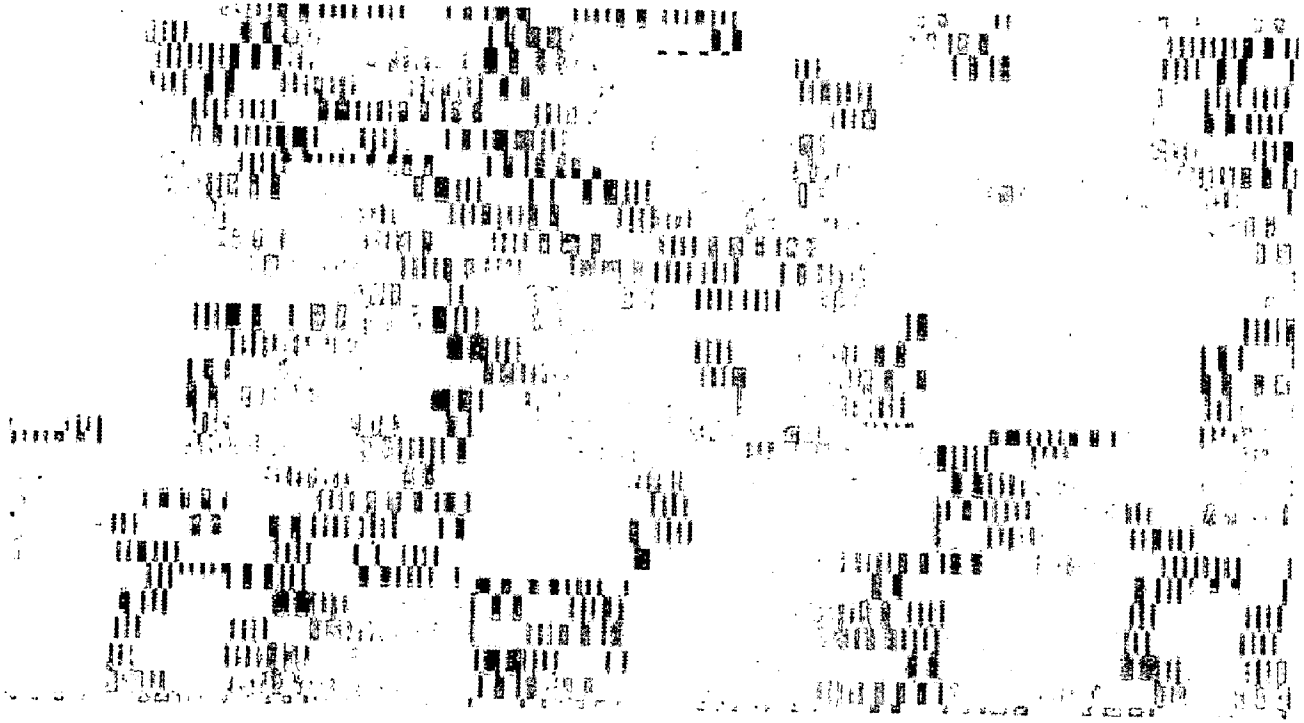
FIG. 12B is an enlarged partial view of the carpet web of FIG. 12A in which each respective color tone is indicative of a combination of a respective color and a respective pile height.

Similar to the previous examples, this exemplary construction includes the use of a predetermined tufting pattern. As shown in FIGS. 11A and 11B, the predetermined tufting pattern is different with respect to both the design member and the predetermined color pattern. In this exemplified embodiment, the predetermined tufting pattern has ten different pile heights across the face of the tufting pattern as exemplified by the different color tones across the pattern. When the predetermined tufting pattern of FIG. 11A is overlaid thereon the colorized design member of FIG. 10A, the carpet web design is fully characterized with respect to color, color shapes, and pile height. In this exemplary aspect, the elements of the void area have a predetermined color and a substantially uniform pile height and are unaffected by the application of the predetermined color pattern and the predetermined tufting pattern.

Figure 13:
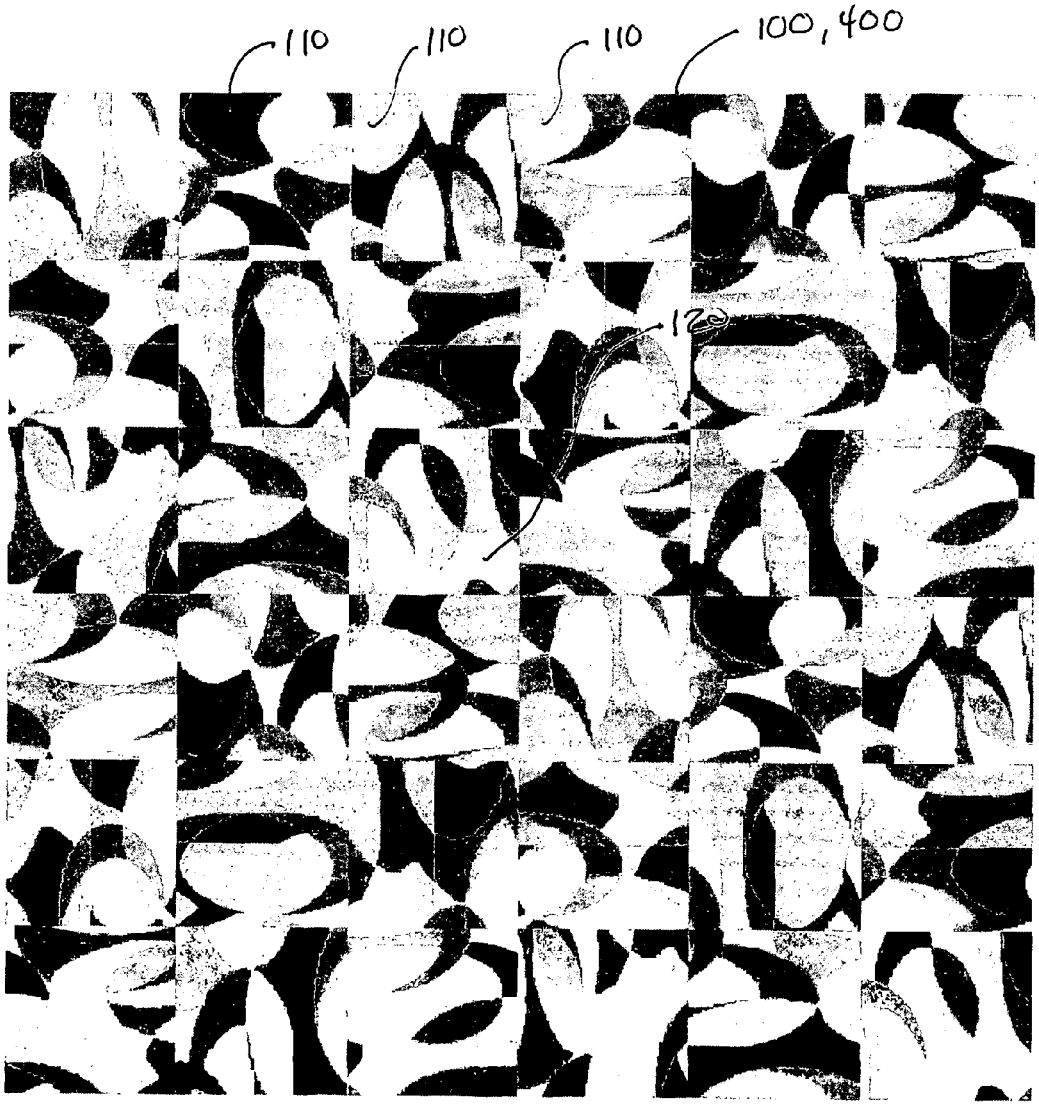
FIG. 13 is a top plan view of a design member of an alternative embodiment of a carpet web produced in accordance with one embodiment of this invention, the design member showing a plurality of pattern members and defining a void area that is not colored by the application of a predetermined color pattern, the design member further showing a predetermined tufting pattern, which, in this exemplified embodiment, is positioned in registration with the pattern members and has ten different pile heights across the face of the carpet web. In this figure, each respective color on the tufting pattern is indicative of a predetermined pile height and the number of successive applications of varying predetermined color patterns that are required to colorize the plurality of pattern members.

Referring now to FIGS. 13-18, an alternative example of a carpet web is shown. In FIG. 13, an exemplified design member is shown having a plurality of pattern members. In this aspect, the design member defines at least a portion of the void area that is not colorized by the subsequent application of the predetermined color patterns. The design member further shows an overlaid predetermined tufting pattern, which, in this exemplified embodiment, is positioned in registration with the pattern members and has ten different pile heights across the face of the carpet web. Thus, in this example, each individual pattern member has a predetermined, substantially, uniform, pile height. Resultantly, in this exemplified aspect, the predetermined tufting pattern has ten different pile heights across the face of the design member as shown by the variation in color tone of the pattern members. In this example, each respective color of the pattern members of the design member is also indicative of the number of applications of predetermined color patterns that need to be successively applied in order to colorize the pattern members.

Figure 14A:
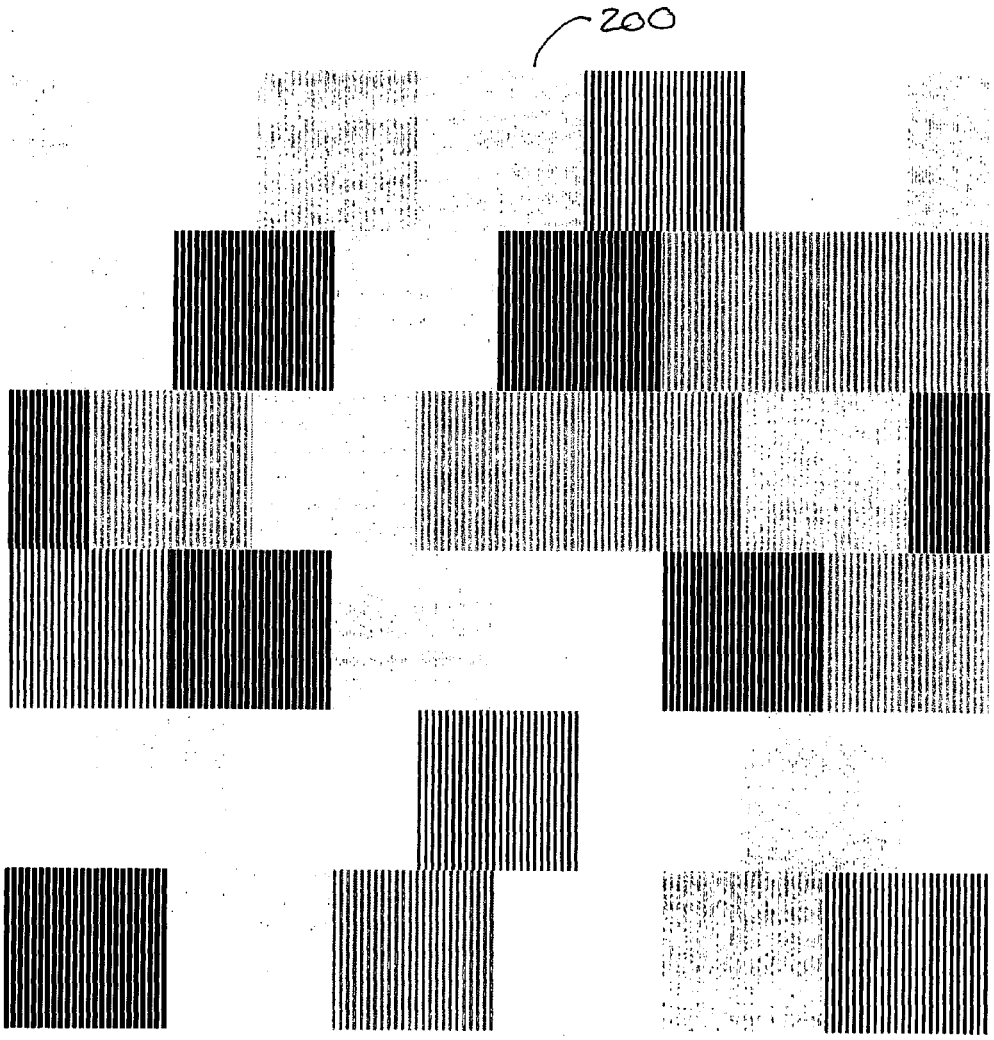
FIG. 14A is a top plan view of one predetermined color pattern of a plurality of color patterns, each color pattern having a plurality of colors dispersed in a predetermined pattern thereon and showing a plurality of line segments oriented in a direction parallel to a production axis of the carpet web, the plurality of line segments defining blank areas that are not colored by the plurality of colors within the predetermined color pattern.
Figure 14B:
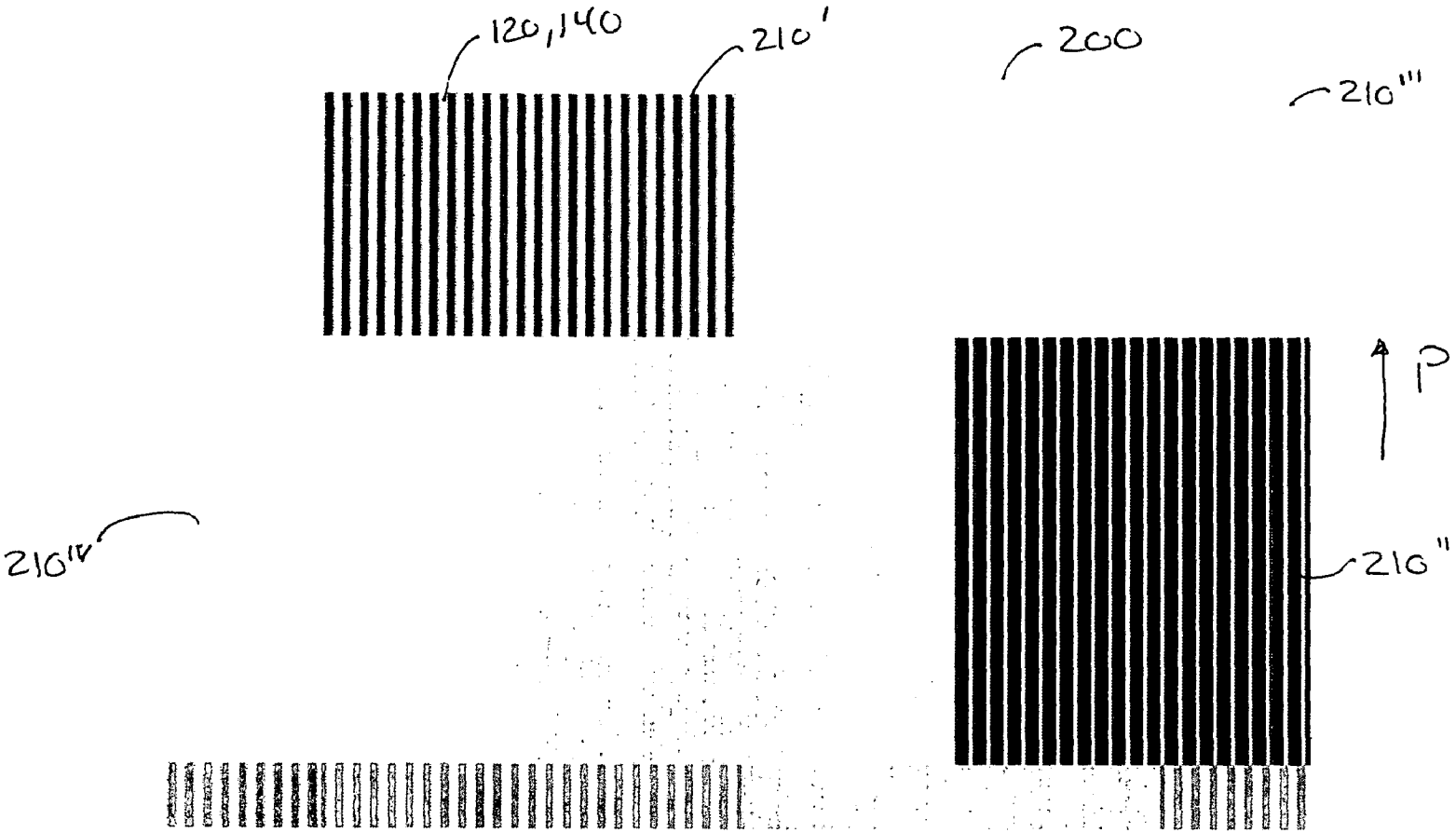
FIG. 14B is an enlarged partial view of the exemplary predetermined color pattern of FIG. 14A.

One predetermined color pattern of a plurality of color patterns is shown in FIG. 14A. This exemplified color pattern uses 11 different colors in a grid-like color pattern. In this aspect, particular line segment arrays are formed in each different color section of the color pattern. Optionally, each line segment is oriented in a direction parallel to the production axis of the carpet web and defines a plurality of line segments defining blank areas that are not colored by the plurality of colors within the predetermined color pattern.

Figure 15A:
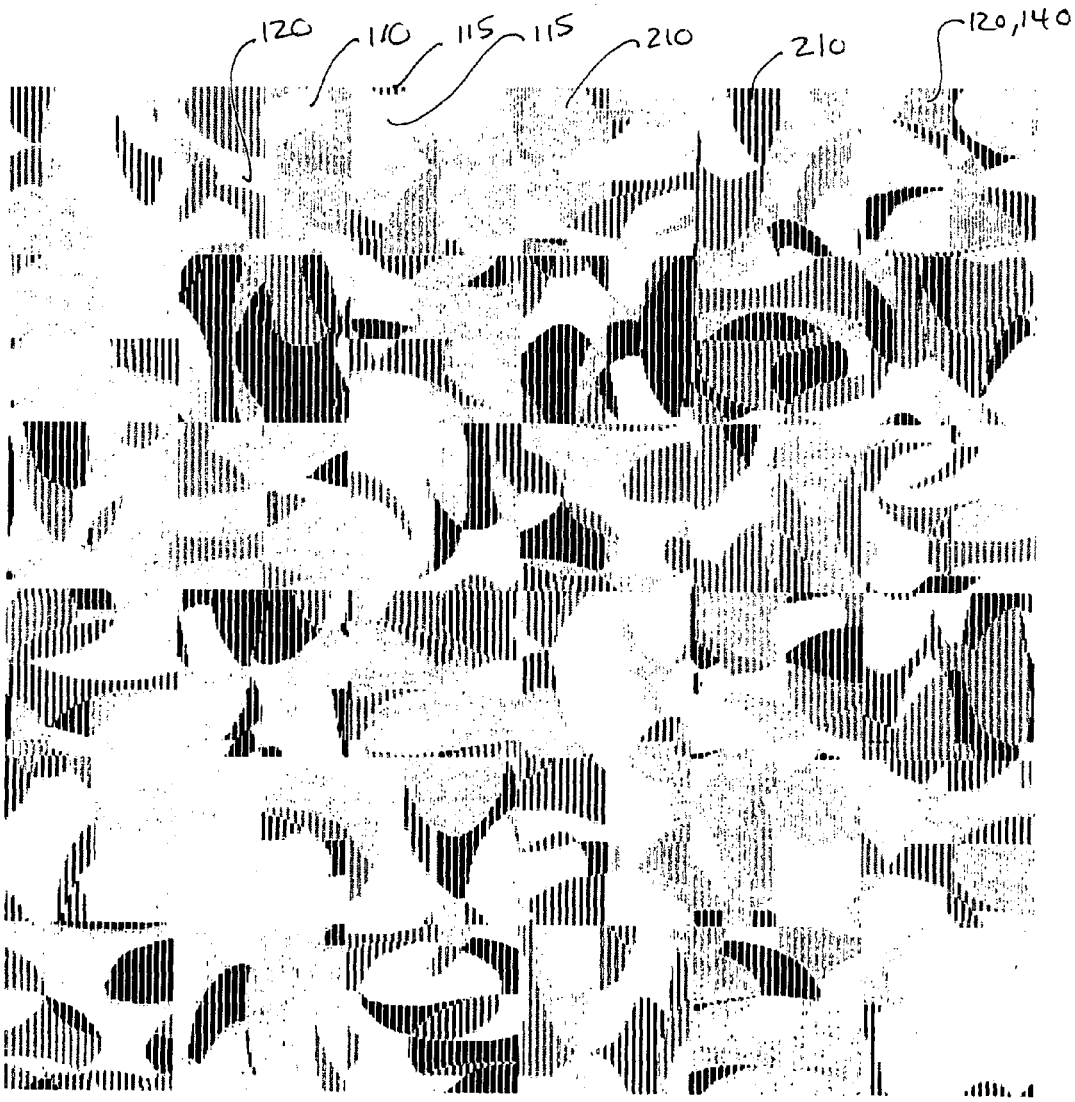
FIG. 15A is a top plan view of the design member of FIG. 13, after each of the plurality of predetermined color patterns have been successively overlaid thereon and showing the line segments forming a portion of the void area of the carpet web. In this example, a different predetermined color pattern is applied to each of pattern members that have a similar pile height.

In operation, one particular color pattern is overlaid onto the design member to colorize particularized or identified pattern members. In one example, each pattern member in the design member that has a substantially uniform pile height, i.e., each individual color tone shown FIG. 13 is colorized by the application of a single predetermined color pattern. Thus, in this example having ten different pile heights, ten different predetermined color patterns are successively applied to the design member to colorize the pattern members of the design. Alternatively, a single color pattern could be used that is applied successively to the design member is ten different orientations to colorize the respective elements. As shown in FIG. 15A, after application of the plurality of color patterns, portions of the pattern members of the design member are colorized to form the discrete color shapes. Further, the "blank" non-colorized elements of the void area, including the line segments, are shown.

Figure 18:
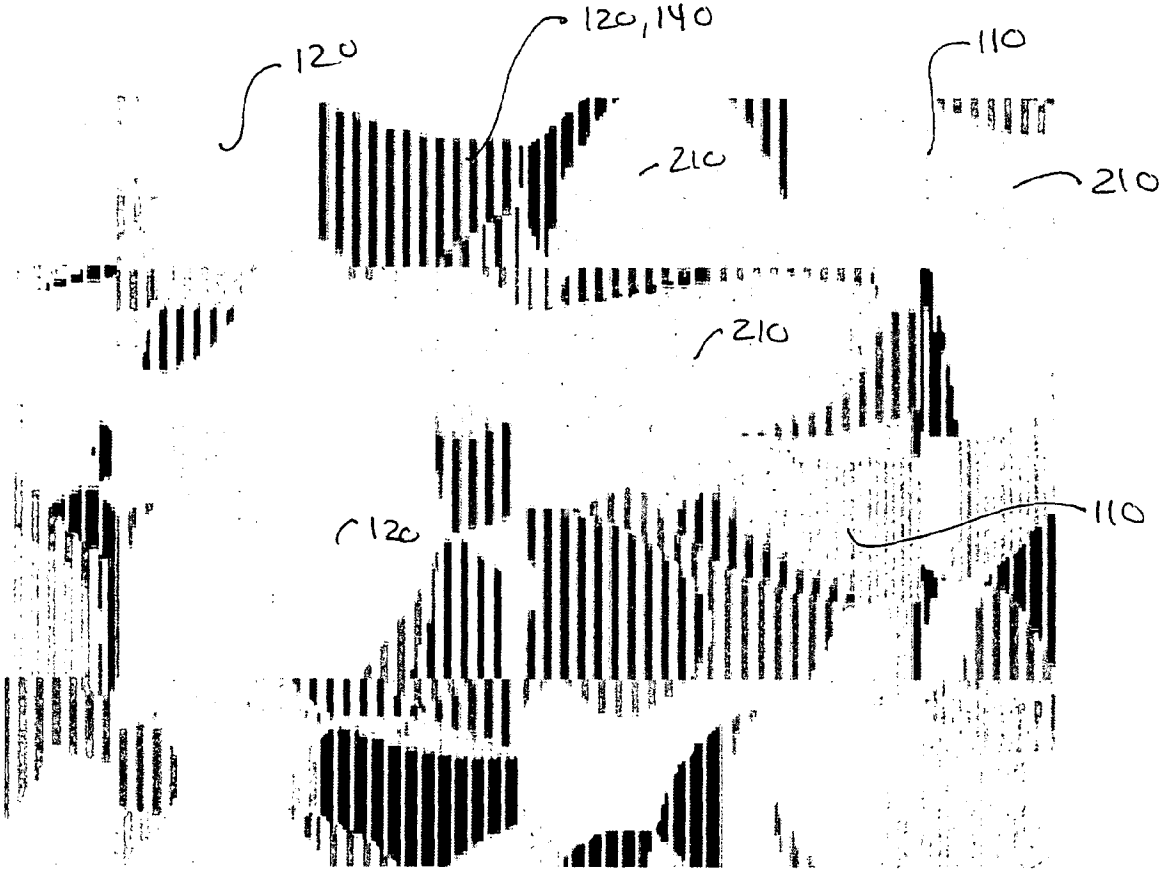
FIG. 18 is a perspective photograph of the carpet web of FIG. 16A.
Figure 16A:
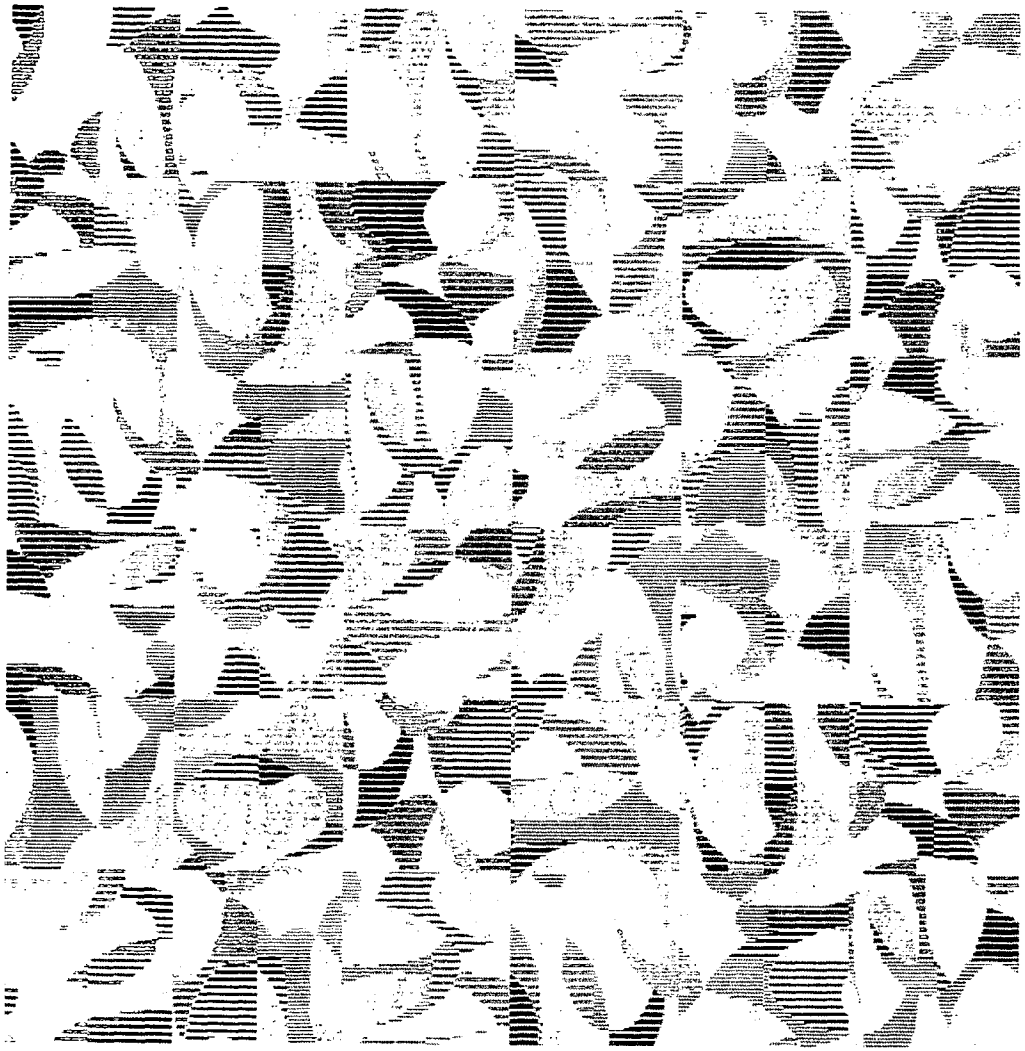
FIG. 16A is a top plan view of the carpet web of FIG. 15A, in which the elements of the void area have a predetermined color and a substantially uniform pile height that are unaffected by the application of the predetermined color patterns and the predetermined tufting pattern.
Figure 16B:
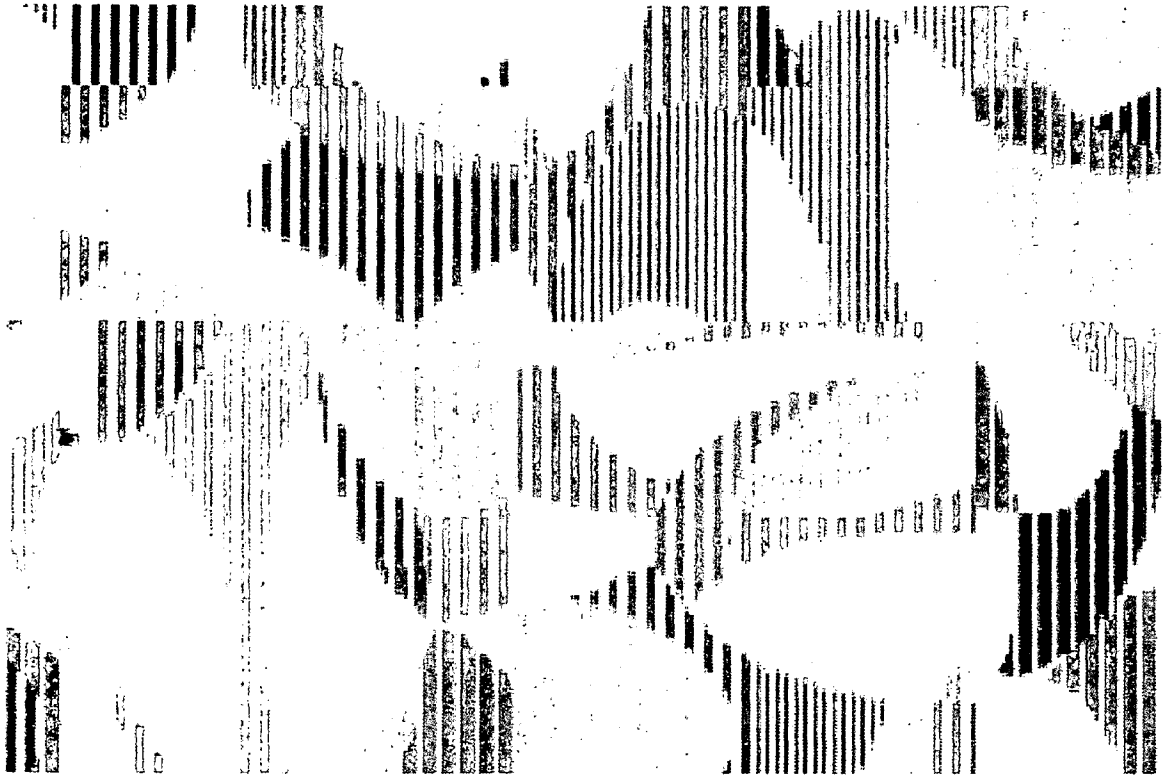
FIG. 16B is an enlarged partial view of the carpet web of FIG. 16A in which each respective color tone in the drawing is indicative of a combination of a respective color and a respective pile height.
Figure 17:
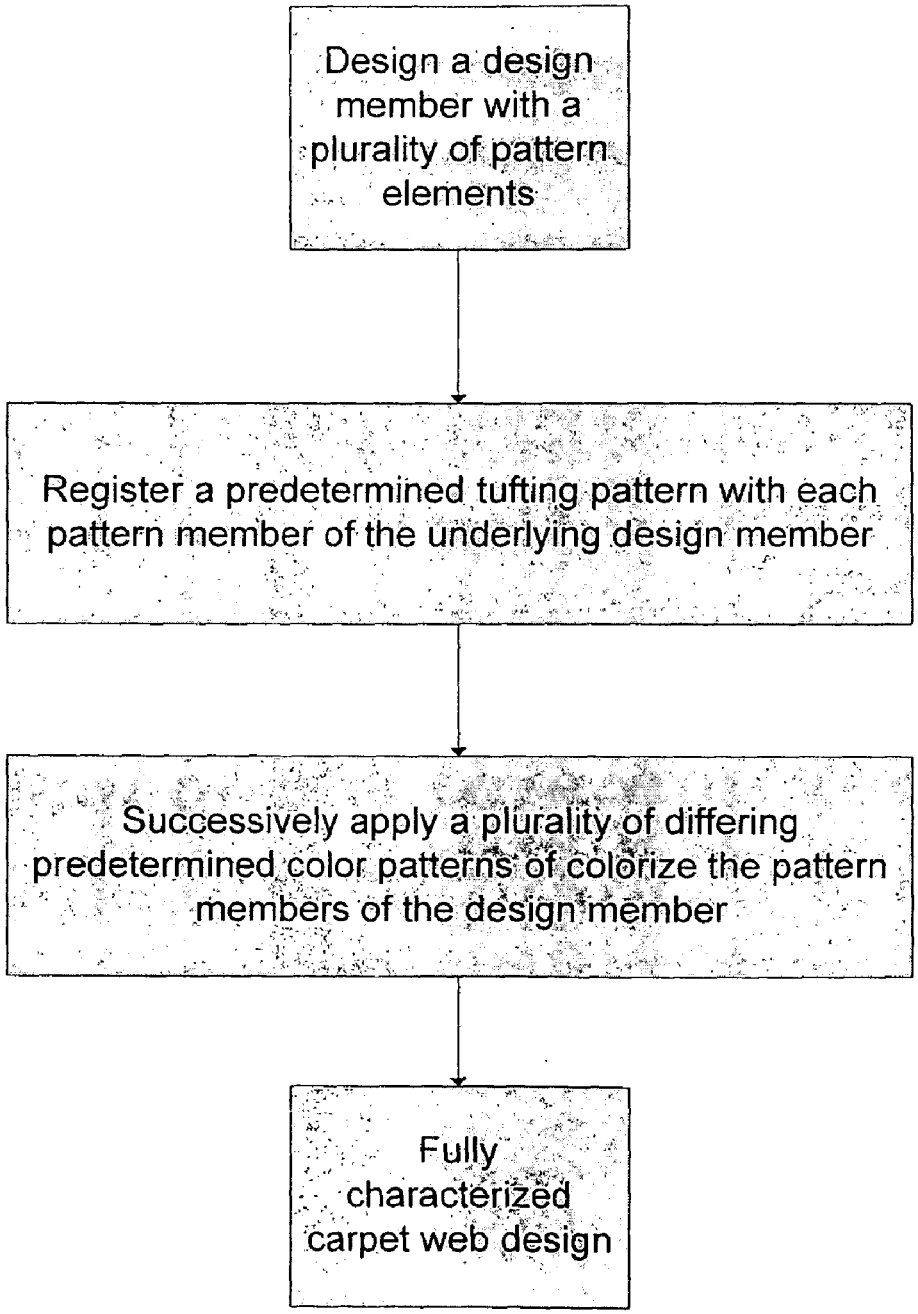
FIG. 17 is an exemplified flowchart of the process of forming the carpet web of FIG. 16A.
Figure 18:
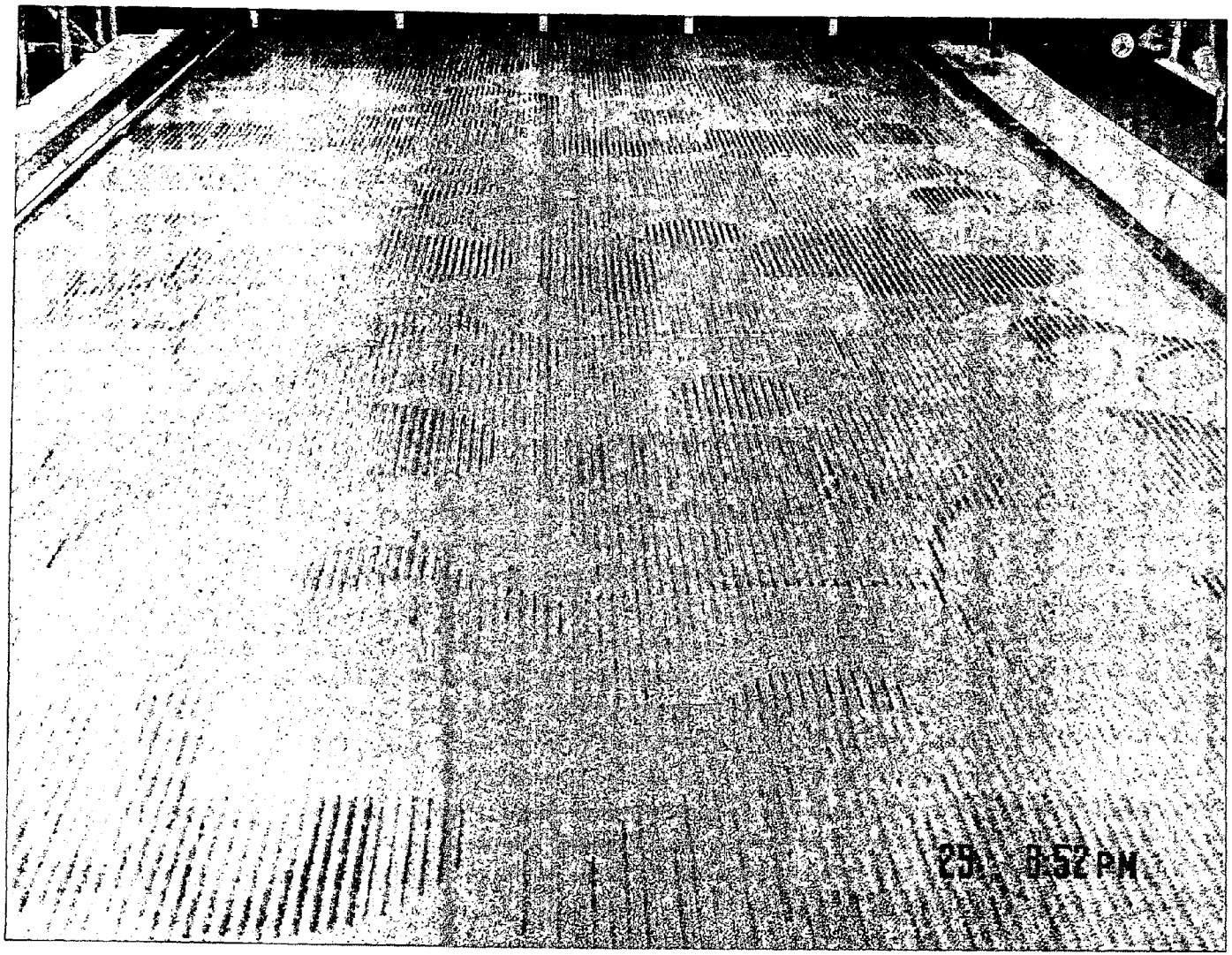

As shown in FIG. 16A, when the colorized design member of FIG. 15A is overlaid thereon the texturized design member of FIG. 13, the carpet web design is fully characterized with respect to color, color shapes, and pile. In this example, the elements forming the void area have a predetermined color and a substantially uniform pile height and are unaffected by the application of the predetermined color pattern and the predetermined tufting pattern. A carpet web manufactured in accord with this example is shown in FIG. 18.

Figure 19A:
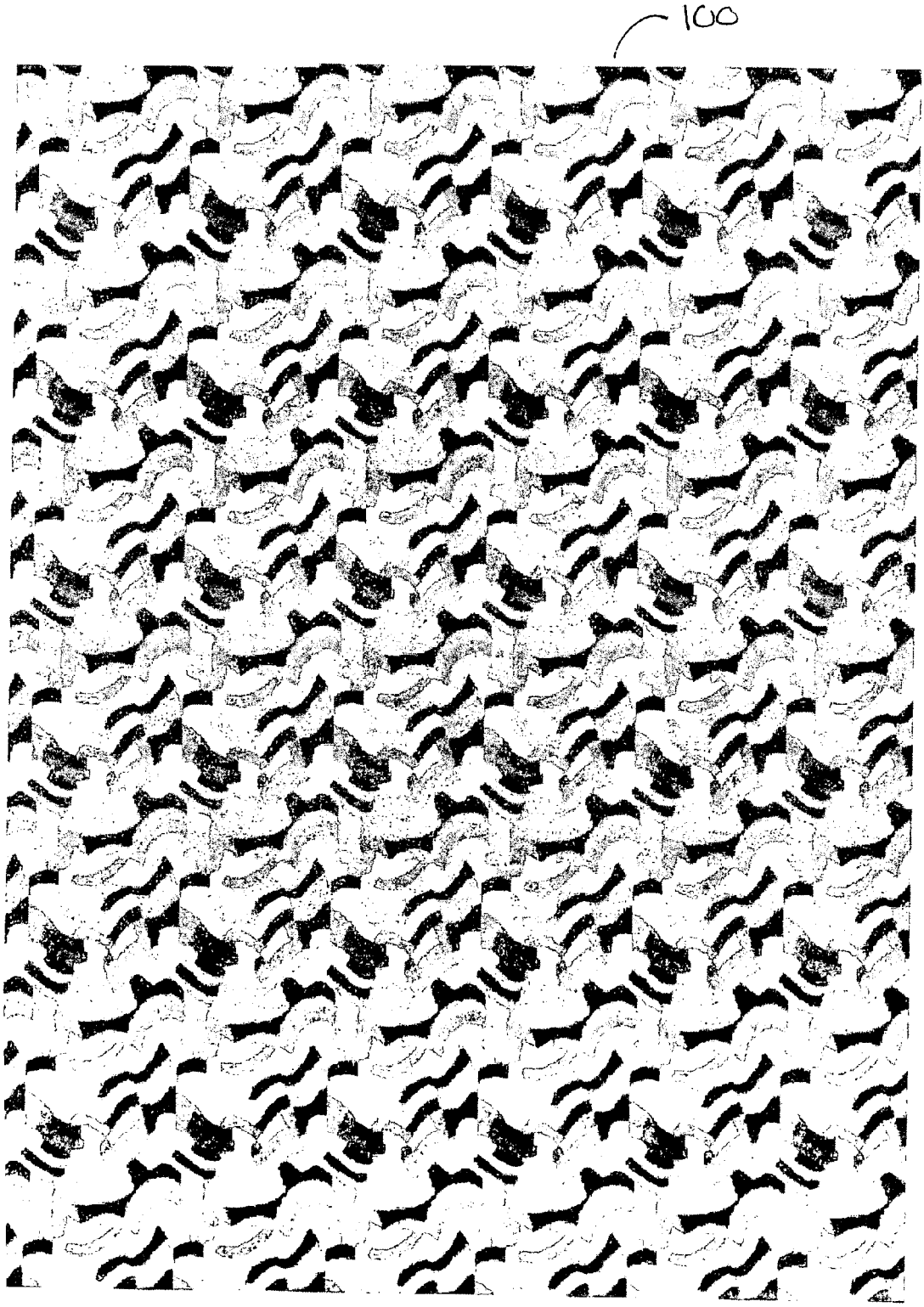
FIG. 19A is a top plan view of a design member of a alternative embodiment of a carpet web produced in accordance with one embodiment of this invention, the design member showing a plurality of pattern members and defining a void area that is not colored by the application of a predetermined color pattern, the design member further showing a predetermined tufting pattern, which, in this exemplified embodiment, is positioned in registration with the pattern members and has nine different pile heights across the face of the carpet web. In this figure, each respective color on the tufting pattern is indicative of a predetermined pile height and the number of successive applications of varying predetermined color patterns that are required to colorize the plurality of pattern members.
Figure 19B:
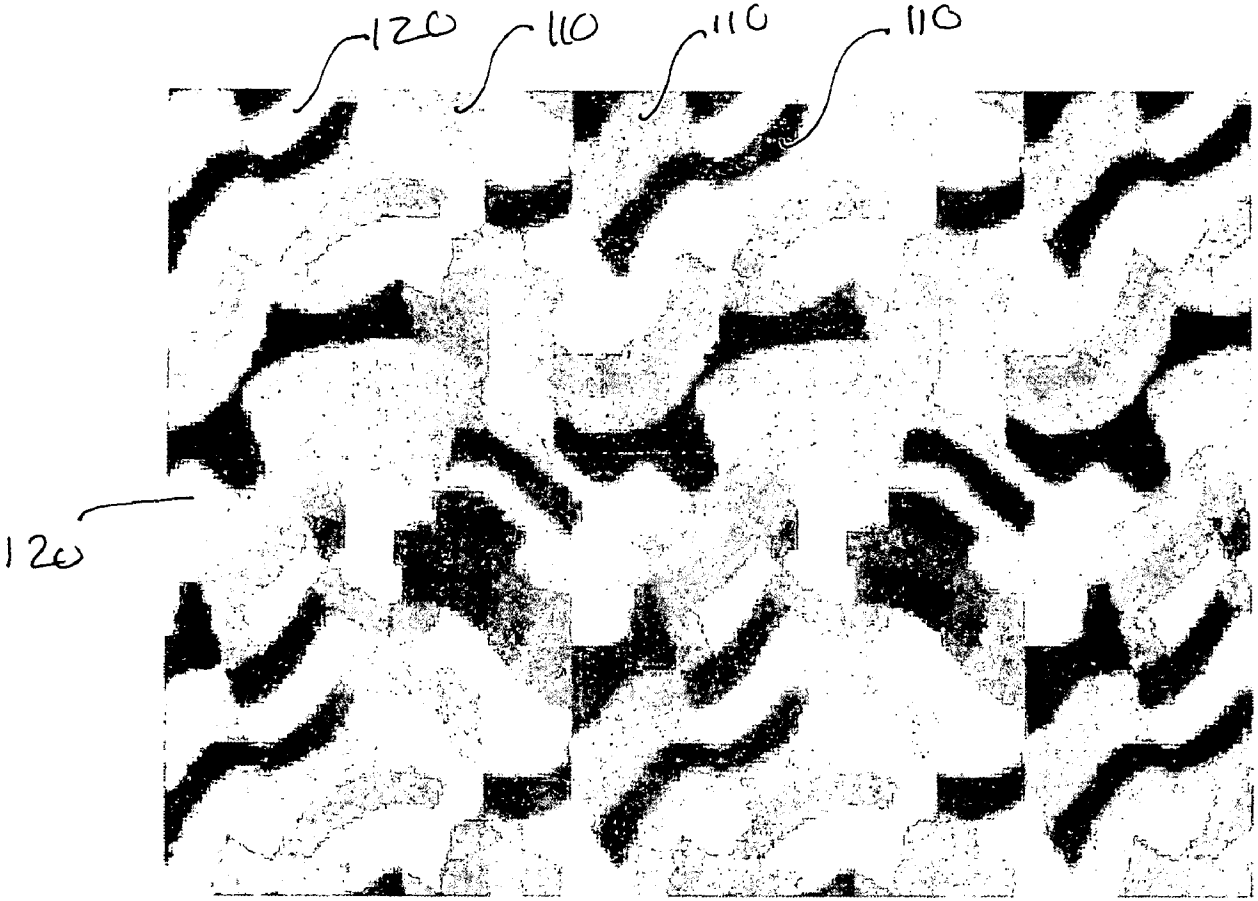
FIG. 19B is an enlarged partial view of the exemplary design member of FIG. 19B.
Figure 20A:
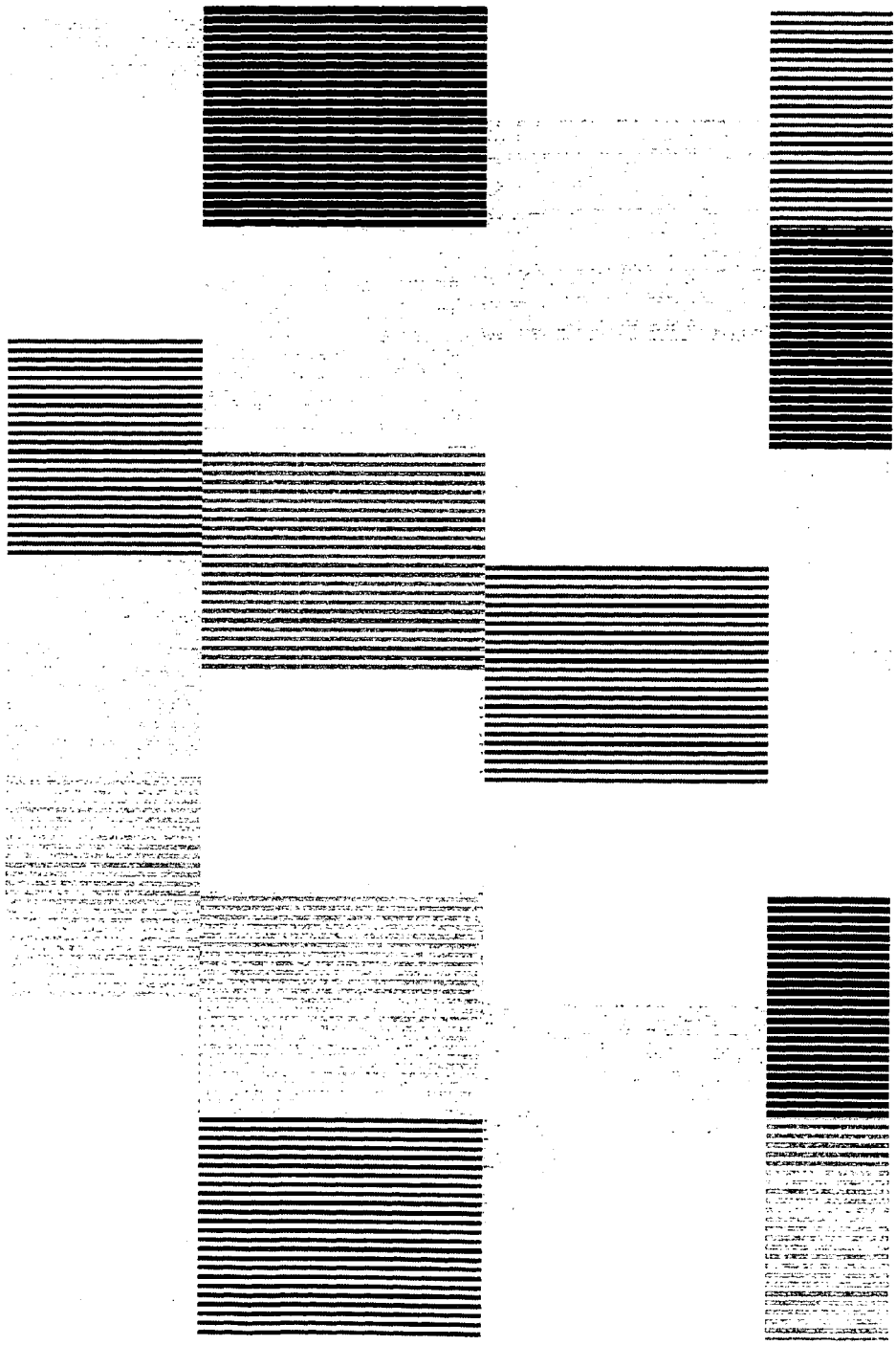
FIG. 20A is a top plan view of one predetermined color pattern of a plurality of color patterns, each color pattern having a plurality of colors dispersed in a predetermined pattern thereon and showing a plurality of line segments oriented in a direction parallel to a production axis of the carpet web, the plurality of line segments defining blank areas that are not colored by the plurality of colors within the predetermined color pattern.
Figure 20B:
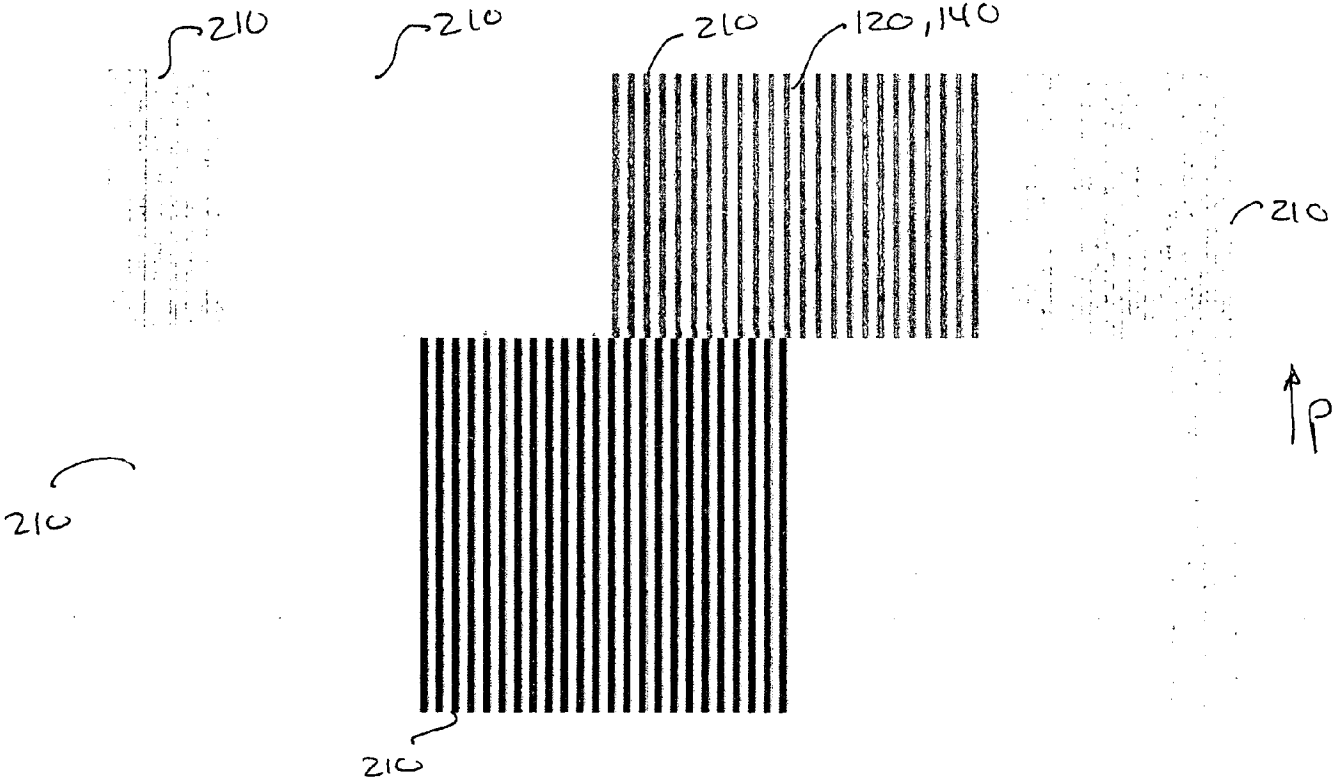
FIG. 20B is an enlarged partial view of the exemplary predetermined color pattern of FIG. 20A.
Figure 21A:
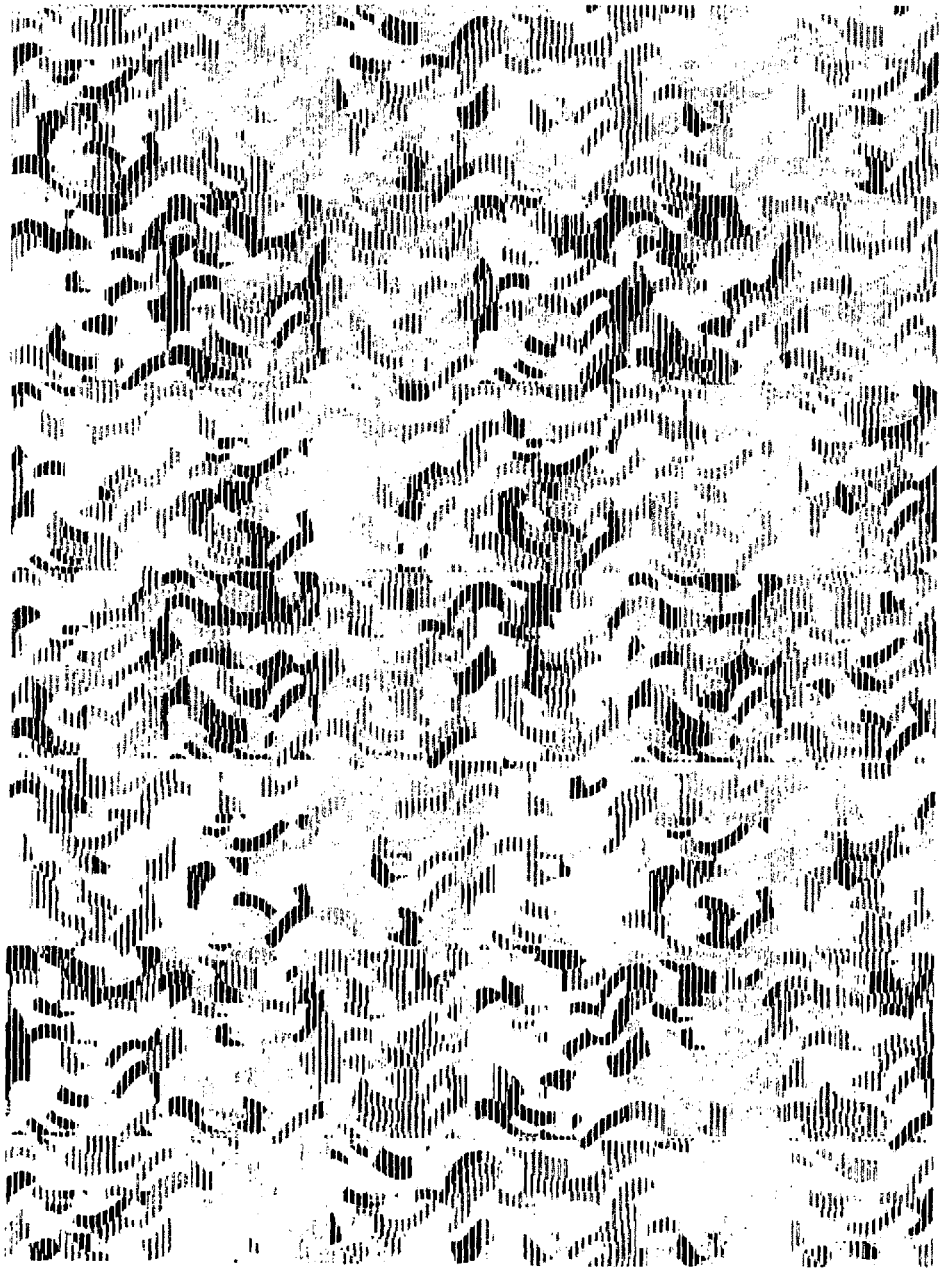
FIG. 21A is atop plan view of the design member of FIG. 19A, after each of the plurality of predetermined color patterns are overlaid thereon and showing the line segments forming a portion of the void area of the carpet web. In this aspect, a different predetermined color pattern is applied to each of pattern members of the design member that has a similar pile height.
Figure 21B:
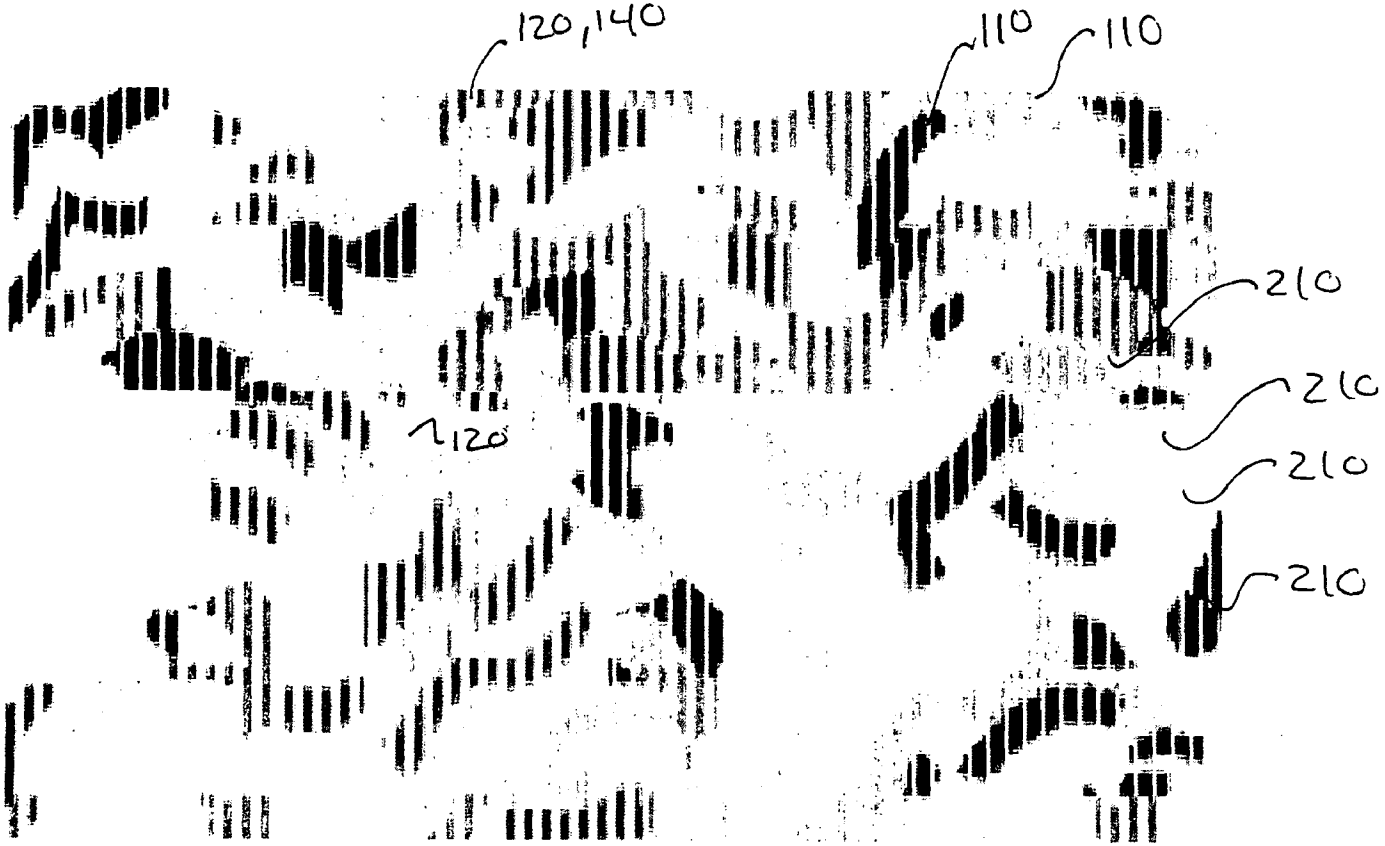
FIG. 21B is an enlarged partial view of the colorized design member of FIG. 21A.
Figure 22A:
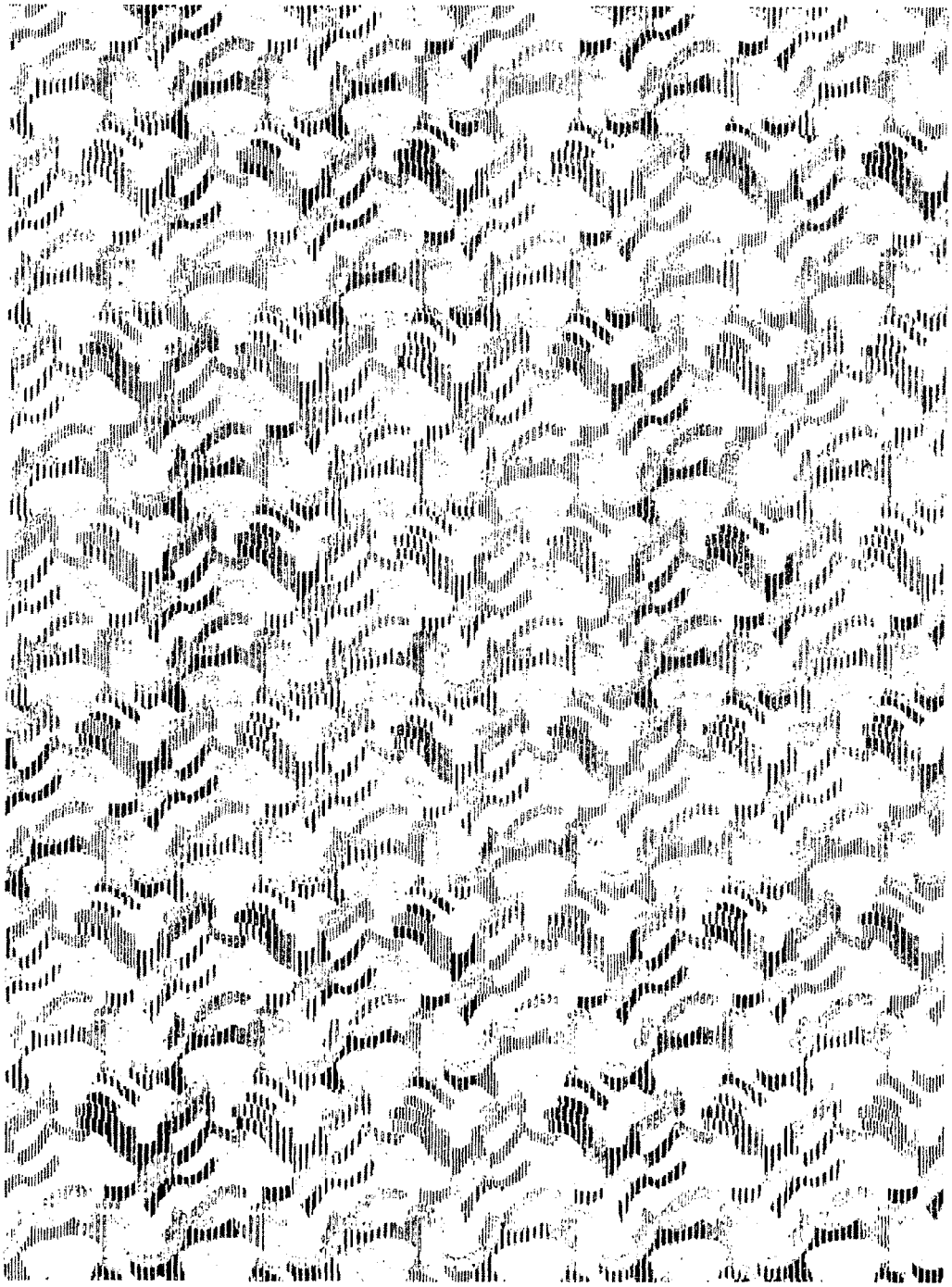
FIG. 22A is a top plan view of the carpet web of FIG. 19A, in which the elements of the void area have a predetermined color and a substantially uniform pile height that are unaffected by the application of the predetermined color pattern and the predetermined tufting pattern.
Figure 22B:
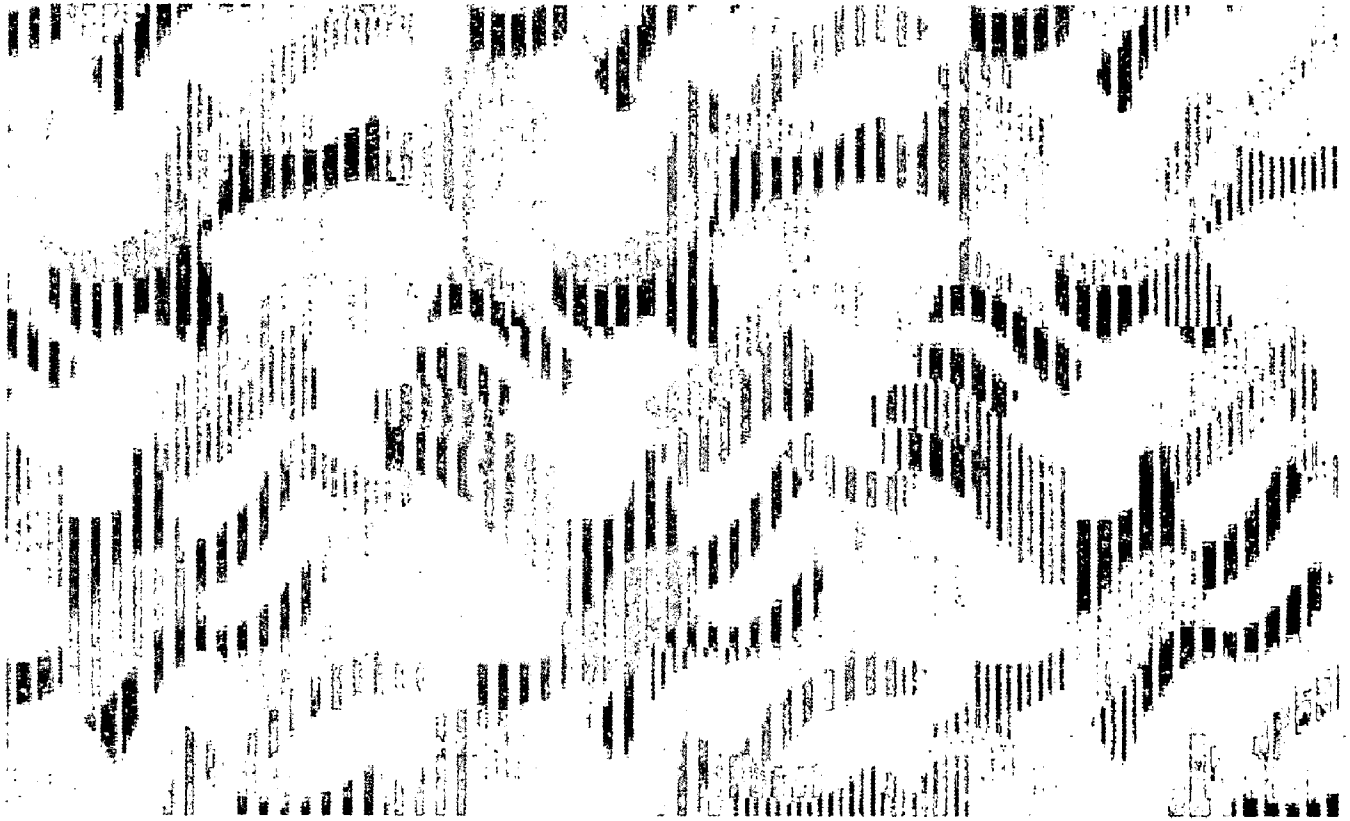
FIG. 22B is an enlarged partial view of the carpet web of FIG. 22A in which each respective color tone in the drawing is indicative of a combination of a respective color and a respective pile height.

FIGS. 19A-22B show an exemplary carpet web designed in accord with the methodology noted immediately above in reference to FIGS. 13-18. In this example, as shown in FIG. 19A, the predetermined tufting pattern has nine different pile heights across the face of the design member. Therefore, nine different predetermined color patterns, such as the predetermined color pattern exemplified in FIG. 20A, are successively applied to achieve the colorized pattern members of the design member shown in FIG. 21A. Referring to FIG. 22A, when the colorized design member of FIG. 21 is overlaid thereon the texturized design member of FIG. 19, the carpet web design is fully characterized with respect to color, color shapes, and pile height.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the described invention. For example, different design members, color patterns, and/or tufting patterns other than those illustrated can be used. Similarly, a wide variety of color combinations forming the individual color pattern are contemplated. Furthermore, while the embodiments described above are tufted, the carpet could also be woven on a conventional or computer controlled Jacquard or other loom, and could be fusion bonded or formed in other manners.

What is claimed is:

1. A method of producing a carpet, comprising:

designing a design member for a carpet web having a production axis, the design member comprising a plurality of pattern members that defines a void area therebetween, the step of designing a design member further comprising forming at least one line segment that at least partially partitions at least one pattern member of the plurality of pattern members, and wherein at least a portion of the void area is formed by the at least one line segment, wherein the void area comprises a substantially uniform void color;

creating at least one predetermined color pattern, each predetermined color pattern formed from a plurality of colors;

overlying a selected one of the at least one predetermined color pattern thereon the design member to colorize at least a portion of at least one pattern member of the plurality of pattern members;

sequentially overlying at least one of the at least one predetermined color pattern thereon the design member until the entirety of the plurality of pattern members are colorized; and producing the carpet web with the colorized pattern members, wherein each predetermined color pattern is differently patterned with respect to the pattern members of the design member.

2. The method of claim 1, wherein at least a portion of the void area is formed therebetween the plurality of pattern members.

3. The method of claim 1, wherein the step of creating the predetermined color pattern further comprises forming a plurality of spaced line segments thereon the predetermined color pattern, each line segment designates blank portions of the predetermined color pattern that are not colored by the plurality of colors, such that, upon overlaying of the predetermined color pattern thereon the design member, the blank portions of the color pattern that overlay the at least one pattern member form a portion of the void area of the design member.

4. The method of claim 1 or 3, further comprising:

creating a predetermined tufting pattern; and overlying the predetermined tufting pattern thereon the design member to control the pile height of the carpet across each of the pattern members.

5. The method of claim 4, wherein the tufting pattern is differently patterned with respect to the pattern members of the design member.

6. The method of claim 4, wherein the tufting pattern is differently patterned from the color pattern.

7. The method of claim 4, wherein the tufting pattern is substantially identical to the design of the design member, and wherein the color pattern is differently patterned from the tufting pattern.

8. The method of claim 4, wherein the carpet web is produced using a tufting machine.

9. The method of claim 8, wherein the plurality of colors comprises a plurality of yarns, wherein the tufting machine comprises needles that are configured to operatively engage select yarns from the plurality of yarns to tuft the carpet web.

10. The method of claim 9, wherein the plurality of yarns comprise space dyed yarns.

11. The method of claim 9, wherein the plurality of yarns comprise single color yarns.

12. The method of claim 9, wherein the plurality of yarns comprise barber pole yarns.

13. The method of claim 1, wherein the step of overlying the predetermined color pattern comprises applying the predetermined color pattern thereto the plurality of element patterns to direct the colorization of each respective pattern member in the plurality of pattern members.

14. The method of claim 13, wherein each respective pattern member is colored by at least two colors of the plurality of colors.

15. The method of claim 13, wherein the predetermined color pattern comprises a plurality of predetermined color patterns, and wherein the step of overlying the predetermined color pattern comprises successively applying the plurality of predetermined color patterns thereto the element pattern to direct the colorization of each pattern member, wherein each respective predetermined color pattern directs the colorization of at least a portion of at least one pattern member.

16. The method of claim 15, wherein each predetermined color pattern has a common orientation axis, and wherein each predetermined color pattern of the plurality of predetermined color patterns is substantially different when viewed from the common orientation axis.

17. The method of claim 15, wherein each predetermined color pattern is differently patterned with respect to the design member.

18. The method of claim 17, wherein each predetermined color pattern is differently patterned with respect to the other predetermined color patterns of the plurality of predetermined color patterns.

* * * * *